US007038704B2

(12) United States Patent
Hosokawa et al.

(10) Patent No.: US 7,038,704 B2
(45) Date of Patent: May 2, 2006

(54) TAPE PRINTING APPARATUS, METHOD OF CONTROLLING PRINTING THEREBY, PROGRAM, AND STORAGE MEDIUM

(75) Inventors: Takeshi Hosokawa, Shiojiri (JP); Akira Hashimoto, Shiojiri (JP); Masanori Konishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 255 days.

(21) Appl. No.: 10/719,994

(22) Filed: Nov. 21, 2003

(65) Prior Publication Data

US 2004/0196353 A1 Oct. 7, 2004

(30) Foreign Application Priority Data

Dec. 4, 2002 (JP) ..... 2002-352035
Dec. 4, 2002 (JP) ..... 2002-352036

(51) Int. Cl.
*B41J 2/36* (2006.01)

(52) U.S. Cl. ..... 347/191

(58) Field of Classification Search ..... 347/191; 400/615.2

See application file for complete search history.

(56) References Cited

U.S. PATENT DOCUMENTS 5,131,767 A * 7/1992 Yamada et al. ..... 400/120.07
6,512,596 B1 * 1/2003 Lapstun ..... 358/1.9
6,738,085 B1 * 5/2004 Hachinoda ..... 347/171
6,824,239 B1 * 11/2004 Hanabusa et al. ..... 347/15
2004/0159252 A1 * 8/2004 Woodman et al. ..... 101/483
2004/0197127 A1 * 10/2004 Shibata et al. ..... 400/615.2

FOREIGN PATENT DOCUMENTS

JP 11-268360 10/1999

* cited by examiner

*Primary Examiner*—K. Feggins
*Assistant Examiner*—Rene Garcia, Jr.
(74) *Attorney, Agent, or Firm*—Hogan & Hartson, L.L.P.

(57) ABSTRACT

A tape printing apparatus prints a print image by each dot line onto a tape. A plurality of heating elements of print head are driven while the tape is moved in a longitudinal direction thereof relative to the print head. The heating elements are aligned corresponding to the dot lines of the print image in which dots are arrayed in a width direction of the tape. With this tape printing apparatus, the number of consecutive blank lines is inspected regarding the print image made up of a mixture of print lines which are the dot lines including the dots to be printed and blank lines which are the dot lines including no dots to be printed. Based on the number of consecutive blank lines, energy applied to the print head is adjusted.

13 Claims, 17 Drawing Sheets

FIG. 6B

| | |
|---|---|
| S10 | PRINT PROCESSING |
| S11 | INITIALIZE NUMBER m OF CONSECUTIVE BLANK LINES(WL) AND NUMBER n OF CONSECUTIVE PRINT LINES(BL) |
| S12 | RETRIEVE PRINT IMAGE DATA(ANALYSIS AND PREPARATION, ETC. OF NEXT LINE) |
| S13 | PRINT LINE? |
| S14 | CLEAR NUMBER n OF CONSECUTIVE BL [n←0] |
| S15 | COUNT NUMBER m OF CONSECUTIVE WL [m←m+1] |
| S16 | PRINTING AFTER ABOVE SET NUMBER M OF BLANK LINES? [M≦m] |
| S17 | COUNT NUMBER n OF CONSECUTIVE BL [n←n+1] |
| S18 | SET NUMBER N OR SMALLER NUMBER OF PRINT LINES? [N≧n ?] |
| S19 | ADJUST STROBE WIDTH(ADJUST APPLIED ENERGY) |
| S20 | PRINT ONE LINE |
| S21 | FINISH PRINTING? |
| S23 | CLEAR NUMBER n OF CONSECUTIVE BL [n←0] |
| S24 | CLEAR NUMBER m OF CONSECUTIVE WL [m←0] |
| S25 | DECREMENT OF m $\begin{cases} m \leftarrow m-1 & (m \geqq 1) \\ m \leftarrow 0 & (m \leqq 0) \end{cases}$ |

FIG. 14B

| | |
|---|---|
| S30 | PRINT PROCESSING |
| S31 | INITIALIZE DURATION k OF CONSECUTIVE BLANK LINES(WL), NUMBER n OF CONSECUTIVE PRINT LINES (BL) AND TIMER VALUE (TIM AND TIM2) |
| S12 | RETRIEVE PRINT IMAGE DATA(ANALYSIS AND PREPARATION, ETC. OF NEXT LINE) |
| S13 | PRINT LINES? |
| S14 | CLEAR NUMBER n OF CONSECUTIVE BL [n←0] |
| S33(S15) | RENEW CONTNUED DURATION k OF WL [k←k+TIM-TIM2] |
| S34 | RETAIN (SAVE) PRESENT TIM [TIM2←TIM] |
| S35(S16) | PRINTING AFTER ABOVE SET DURATION K OF BLANK LINES IS ELAPSED? [K≦k ?] |
| S17 | COUNT NUMBER n OF CONSECUTIVE BL [n←n+1] |
| S18 | SET NUMBER N OR SMALLER NUMBER OF PRINT LINES? [N≧n ?] |
| S19 | ADJUST STROBE WIDTH (ADJUST APPLIED ENERGY) |
| S20 | PRINT ONE LINE |
| S21 | FINISH PRINTING? |
| S23 | CLEAR NUMBER n OF CONSECUTIVE BL [n←0] |
| S36(S24) | CLEAR DURATION k OF CONSECUTIVE WL [k←0] |

TAPE PRINTING APPARATUS, METHOD OF CONTROLLING PRINTING THEREBY, PROGRAM, AND STORAGE MEDIUM

BACKGROUND OF THE INVENTION

1. Field of the Invention

The present invention relates to: a tape printing apparatus and a method of controlling printing by the tape printing apparatus in which a print image is printed by using a thermal print head onto a tape which is an object to be printed; a program; and a storage medium.

2. Description of the Related Art

From the viewpoint of principle, an amount of accumulated heat in a thermal type of print head (thermal head) changes (decreases) due to heat dissipation in accordance with elapsed time from previous printing. However, dot rows (dot lines) of a print image, in which dots are arrayed in a tape width direction, have a regular interval therebetween. Therefore, in a conventional tape printing apparatus, heating control (print control) is performed in accordance with a relative moving speed so that the amount of accumulated heat for printing each of the dot lines is within a predetermined range, in other words, so that the amount of heat dissipation is uniform among the dot lines (for example, see FIGS. 9 to 23 and related description in Published Unexamined Japanese Patent Application No. 268360/1999).

However, in the above mentioned principle, no consideration is given to the difference in content of a print image and a printing speed. In concrete, when printing a dot line (print line) which includes at least one dot to be printed (heated), a predetermined amount of accumulated heat can be maintained because of the heating. In case, however, the dot lines (blank lines) including no dots to be printed are consecutive, e.g., when there is a blank between paragraphs or letters in the print image, the print head is cooled down to about ambient temperature. Therefore, even if standard strobe signals are applied for printing the following print lines, a heat quantity required to print each pixel (dot) of the image becomes insufficient. Thus, a size of each dot is reduced and image quality is deteriorated.

The present invention has an advantage of providing a tape printing apparatus as well as a method of controlling the printing by the tape printing apparatus in which applied energy to a print head is adjusted to prevent image deterioration of a print image. The present invention also has an advantage of providing a program and a storage medium.

SUMMARY OF THE INVENTION

According to one aspect of the present invention, there is provided a tape printing apparatus for printing a print image by each dot line onto a tape by driving a plurality of heating elements of a print head while moving the tape in a longitudinal direction thereof relative to the print head, the heating elements being aligned corresponding to the dot lines of the print image where dots are arrayed in a width direction of the tape. The tape printing apparatus comprises: line inspecting means for inspecting blank lines and a number of consecutive blank lines in the print image made up of a mixture of print lines which are the dot lines including the dots to be printed and blank lines which are the dot lines including no dots to be printed; and applied energy adjusting means for adjusting energy applied to the print head in printing a print line which follows the consecutive blank lines, the adjusting being made based on the number of the consecutive blank lines.

According to another aspect of the present invention, there is provided a method of controlling printing by a tape printing apparatus for printing a print image by each dot line onto a tape by driving a plurality of heating elements of a print head while moving the tape in a longitudinal direction thereof relative to the print head, the heating elements being aligned corresponding to the dot lines of the print image where dots are arrayed in a width direction of the tape. The method comprises the steps of: inspecting blank lines and a number of consecutive blank lines in the print image made up of a mixture of print lines which are the dot lines including the dots to be printed and blank lines which are the dot lines including no dots to be printed; and adjusting energy applied to the print head in printing a print line which follows the consecutive lank lines, the adjusting being made based on the number of the consecutive blank lines.

In the tape printing apparatus and the method of controlling printing by a tape printing apparatus, the energy to be applied to the print head in printing a print line which follows the consecutive blank lines, and the adjusting is made based on the number of the consecutive blank lines. In concrete, when the number of consecutive blank lines is above or more than a predetermined number, an amount of accumulated heat of the print head becomes insufficient due to heat dissipation. The applied energy can thus be adjusted in a manner to increase the energy to be applied depending on the content of the print image. As a result, the image quality degradation of the print image can be prevented by adjusting the energy applied to the print head.

Preferably, the tape printing apparatus further comprises dot line reading means for reading out the print image by each dot line while printing. The line inspecting means includes: line determining means for determining whether the read-out dot line is the blank line or the print line; and means for detecting the number of consecutive blank lines up to a point when the read-out dot line is determined to be the blank line. The applied energy adjusting means adjusts the applied energy based on the number of the consecutive blank lines that are detected at a point of time when the read-out dot line is determined to be the print line.

In this tape printing apparatus, a print image is read out by each dot line while printing and the dot line which is read out is determined (analyzed) as to whether it is the blank line or the print line. When the dot line is determined to be the blank line, the blank line and the number of consecutive blank lines are inspected (analyzed) by detecting the number of consecutive blank lines at that point. Therefore, the dot lines can be inspected in parallel with the reading out at the time of printing. When the read-out dot line is determined to be the print line, the applied energy is adjusted based on the number of consecutive blank lines detected up to that point of determination. Therefore, the applied energy for the dot line determined to be the print line can be adjusted immediately before the print line is printed. In other words, line inspection is not required prior to printing but can be added into a print processing flow immediately before printing of the print line.

Preferably, the applied energy adjusting means increases a value of the applied energy when the number of the consecutive blank lines is above a previously set number of the blank lines.

In this tape printing apparatus, the applied energy is increased when printing the print lines which follow above a predetermined set number of consecutive blank lines. Therefore, sufficient quantity of heat can be provided for the print head where the amount of accumulated heat is not sufficient due to heat dissipation because of the consecutive blank lines.

Furthermore, preferably, the applied energy adjusting means has means for initializing the number of consecutive blank lines at a time of starting the printing of the print image, into a value above the set number of the blank lines or a value close thereto.

In this tape printing apparatus, the number of consecutive blank lines at the point when printing of the print image is started is initialized into a value above the set number of the blank lines or the value close thereto. Therefore, the number of consecutive blank lines becomes a large value after the printing of the print image is started, even if there is none of, or only a small number of, the consecutive blank lines. Due to this, the heat dissipation before starting the printing can be regarded equal to that when the consecutive blank lines are present. Therefore, when printing the first print line after the printing is started, a sufficient quantity of heat can be provided to the print head in which amount of accumulated heat is not sufficient when printing is started.

Preferably, the line inspecting means further includes means for detecting the number of the consecutive print lines up to the read-out print line when the read-out dot line is determined to be the print line and when the number of the consecutive blank lines detected up to that point of time is above the set number of the blank lines, and the applied energy adjusting means resets the value of the increased applied energy at a stage where the number of the consecutive print lines reaches a previously set number of the print lines.

In this tape printing apparatus, when the print line is printed after more than the set number of consecutive blank lines are present and more than the set number of consecutive print lines are present thereafter, the energy is applied to the print head after the value thereof is reset, considering that the print head has a sufficient amount of accumulated heat by having increased the applied energy supplied thereto. Thus, excessive heating and image quality degradation caused thereby can be prevented.

Preferably, the adjustment of the applied energy is carried out by multiplying a value serving as a reference by a predetermined coefficient.

In this tape printing apparatus, adjustment of the applied energy is carried out by adjusting at least one of the pulse width of the strobe pulse, the applied voltage and the limiting value of the applied current, which are applied to the print head. First of all, adjustment of a strobe pulse application duration can be carried out by adjusting (increasing or decreasing) the strobe width. Therefore, the applied energy can be adjusted even if the applied voltage and the applied current provided by each unit time remain unchanged. In addition, heat generated in the print head is so-called Joule heat. Hence, adjustment of the applied energy to be provided can be carried out by adjusting the applied voltage or the applied current even if the rest of conditions remain unchanged.

Moreover, in the foregoing tape printing apparatus, preferably, the adjustment of the applied energy is carried out by multiplying a value serving as a reference by a predetermined coefficient.

In this tape printing apparatus, the adjustment of the applied energy is carried out by multiplying the value serving as a reference (reference value or standard value) by the predetermined coefficient. In concrete, predetermined coefficients are prepared (stored) in a table or the like and read out to multiply the reference value. For example, the strobe width is increased or decreased by multiplying a standard strobe width by the coefficient, or a standard applied voltage or a standard applied current can be increased or decreased by being multiplied by the coefficient. Consequently, the applied energy can be adjusted.

According to yet another aspect of the present invention, there is provided a tape printing apparatus for printing a print image by each dot line onto a tape by driving a plurality of heating elements of a print head, the heating elements being aligned corresponding to the dot lines of the print image where dots are arrayed in a width direction of the tape, while moving the tape in a longitudinal direction thereof relative to the print head. The tape printing apparatus comprises: dot line analyzing means for analyzing each of the dot lines of the print image made up of a mixture of print lines which are the dot lines including the dots to be printed and blank lines which are the dot lines including no dots to be printed, whereby each of the dot lines is analyzed to be the print line or the blank line, thereby obtaining a line analysis result; means for detecting, based on the line analysis result, a duration of the consecutive blank lines when printing is not consecutively performed while the tape is moved, due to the consecutive blank lines on the tape in a longitudinal direction thereof; applied energy adjusting means for adjusting the energy applied to the print head in printing each of the print lines, based on the duration of the consecutive blank lines and the number of the consecutive print lines from the line analysis result.

Further, according to yet another aspect of the present invention, there is provided a method of controlling printing by a tape printing apparatus for printing a print image by each dot line onto a tape by driving a plurality of heating elements of a print head while moving the tape in a longitudinal direction thereof relative to the print head, the heating elements being aligned corresponding to the dot lines of the print image where dots are arrayed in a width direction of the tape. The method comprises the steps of: analyzing each of the dot lines of the print image made up of a mixture of print lines which are the dot lines including the dots to be printed and blank lines which are the dot lines including no dots to be printed, whereby each of the dot lines is analyzed to be the print line or the blank line, thereby obtaining a line analysis result; detecting a duration of consecutive blank lines based on the line analysis result when printing is not continuously performed, while the tape is moved, due to the consecutive blank lines on the tape in a longitudinal direction thereof; and adjusting energy to be applied to the print head in printing a print line, based on the duration of the consecutive blank lines and the number of the consecutive print lines according to the line analysis result.

In this tape printing apparatus and the method of controlling printing thereby, each of the dot lines of the print image is analyzed whether it is the print line or the blank line, which becomes the line analysis result. Thereafter, detected is the duration of consecutive blank lines when printing is not continuously performed due to the blank lines on the tape which is relatively moved in order to print the print image thereon. In addition, the energy to be applied to the print head is adjusted to print each of the print lines, based on the duration of consecutive blank lines and the number of consecutive print lines. In other words, in case where the duration of consecutive blank lines is above the predetermined duration, the amount of accumulated heat of the print head becomes insufficient due to heat dissipation. Therefore, the applied energy is increased. In case where more than the predetermined number of print lines are consecutively present, the amount of accumulated heat becomes sufficient, and the applied energy is adjusted to an appropriate level for the accumulated heat. In this case, the elapsed time varies with a printing speed, as well as with (the line analysis result based on) the content of the print image. Hence, the image quality degradation of the print image can be prevented by adjusting the energy applied to the print head, corresponding to the content of the print image and the printing speed.

In the aforementioned tape printing apparatus, preferably, the applied energy adjusting means has applied energy increasing means for increasing the value of the applied energy when printing the print line after the duration of the consecutive blank lines reaches a value above a set duration of the consecutive blank lines.

In this tape printing apparatus, the value of the applied energy is increased when printing the print line after the duration of consecutive blank lines reaches more than the set duration of consecutive blank lines. Therefore, a sufficient quantity of heat can be provided to the print head in which the amount of accumulated heat is insufficient due to heat dissipation because of the duration of consecutive blank lines.

Further, in the above mentioned tape printing apparatus, preferably, the means for detecting the duration of consecutive blank lines has means for initializing an initial value of the duration of the consecutive blank lines to a value above a predetermined value, when the printing of the print image is started.

In this tape printing apparatus, the initial value of the duration of consecutive blank line is set to be the predetermined value or a greater value. Thus, after the printing of the print image is started, the value of the duration of consecutive blank lines becomes large even though none of, or only a small number of, blank lines are consecutively present. Due to this, the heat dissipation before the printing is started can be regarded equal to heat dissipation due to consecutive blank lines. Therefore, when printing the first print line after the printing is started, a sufficient quantity of heat can be provided to the print head in which the amount of accumulated heat is insufficient when the printing is started.

In this tape printing apparatus, preferably, the applied energy adjusting means has applied energy reset means which resets the value of the increased applied energy to an original value in case where more than the set duration time of the blank lines is elapsed and in case the print line is printed after more than the set number of the consecutive print lines lasted.

In this tape printing apparatus, in case where more than the set duration of the blank lines is elapsed, the print lines are printed after more than the set number of consecutive print lines are present. At this time, the value of the energy applied to the print head is reset, presuming that the print head has a sufficient amount of accumulated heat by being supplied with the increased applied energy. Thus, excessive heating and image quality degradation due to the excessive heating can be prevented.

Moreover, in the above-described tape printing apparatus, preferably, adjustment of the applied energy is carried out by adjusting a strobe width of a strobe pulse which is applied to the print head.

In this tape printing apparatus, adjustment of the applied energy is carried out by adjusting a strobe width of a strobe pulse which is applied to the print head. In other words, adjustment of strobe pulse application duration can be carried out by adjusting (increasing or decreasing) the strobe width. Thus, the applied energy can be adjusted even if an applied voltage and an applied current provided by each unit time are unchanged.

Further, in the tape printing apparatus, preferably, the adjustment of the applied energy is carried out by adjusting a voltage applied to the print head.

In this tape printing apparatus, the adjustment of the applied energy is carried out by adjusting the voltage applied to the print head. In other words, heat generated in the print head is so-called Joule heat. Hence, the adjustment of the applied energy to be provided can be carried out by adjusting the applied voltage even if the rest of conditions such as the applied current and the application duration remain unchanged.

Moreover, in the foregoing tape printing apparatus, preferably, the adjustment of the applied energy is carried out by adjusting a limit value of a current applied to the print head.

In this tape printing apparatus, the adjustment of the applied energy is carried out by adjusting the limiting value of the applied current which is provided to the print head. In other words, the adjustment of the applied energy can be carried out by adjusting the applied current even though the rest of the conditions such as the applied voltage and the application time remain unchanged.

Furthermore, in the above mentioned tape printing apparatus, preferably, the adjustment of the applied energy is carried out by multiplying a value serving as a reference by a predetermined coefficient.

In this tape printing apparatus, the adjustment of the applied energy is carried out by multiplying the value serving as a reference (reference value or standard value) by the predetermined coefficient. In other words, predetermined coefficients are prepared (stored) in a table or the like and read out to multiply the reference value. Thus, for example, the strobe width is increased or decreased by multiplying a standard strobe width by the coefficient, or a standard applied voltage or a standard applied current can be increased or decreased by being multiplied by the coefficient. Consequently, the applied energy can be adjusted.

According to yet another aspect of the present invention, there is provided a program for performing a function of each of the means of the above-described tape printing apparatus. The program is arranged to be capable of being implemented by a programmable tape printing apparatus.

Further, according to yet another aspect of the present invention, there is provided a program for performing the method of controlling printing by the above-described tape printing apparatus. The program is arranged to be capable of being implemented by a programmable tape printing apparatus.

These programs adjust energy applied to a print head corresponding to the content of the print image, by being processed by the tape printing apparatus in which a program can be processed. Thus, image quality degradation of a print image can be prevented.

Still further, according to yet another aspect of the present invention, there is provided a storage medium having stored therein a program for performing a function of each of the means of the above-described tape printing apparatus. The program is arranged to be capable of being implemented by a programmable tape printing apparatus.

Moreover, according to yet another aspect of the present invention, there is provided a storage medium having stored therein a program for performing a function of each of the means of the above-described tape printing apparatus. The program is arranged to be capable of being implemented by a programmable tape printing apparatus.

In the tape printing apparatus in which a program can be processed, the program stored in the storage medium is read out and executed. Consequently, energy applied to the print head is adjusted corresponding to the content of the print image and a printing speed, thus preventing image quality degradation of the print image.

BRIEF DESCRIPTION OF THE DRAWINGS

The above and other objects and the attendant features of this invention will become readily apparent by reference to the following detailed description when considered in conjunction with the accompanying drawings wherein:

FIGS. 6A and 6B are a flow chart and descriptive part thereof showing an example of print processing;

FIGS. 14A and 14B are a flow chart and descriptive part thereof showing an example of print processing in a second embodiment.

DETAILED DESCRIPTION OF THE PREFERRED EMBODIMENTS

A tape printing apparatus according to a first embodiment of the present invention is described in detail hereinbelow with reference to the attached drawings.

Figure 1:
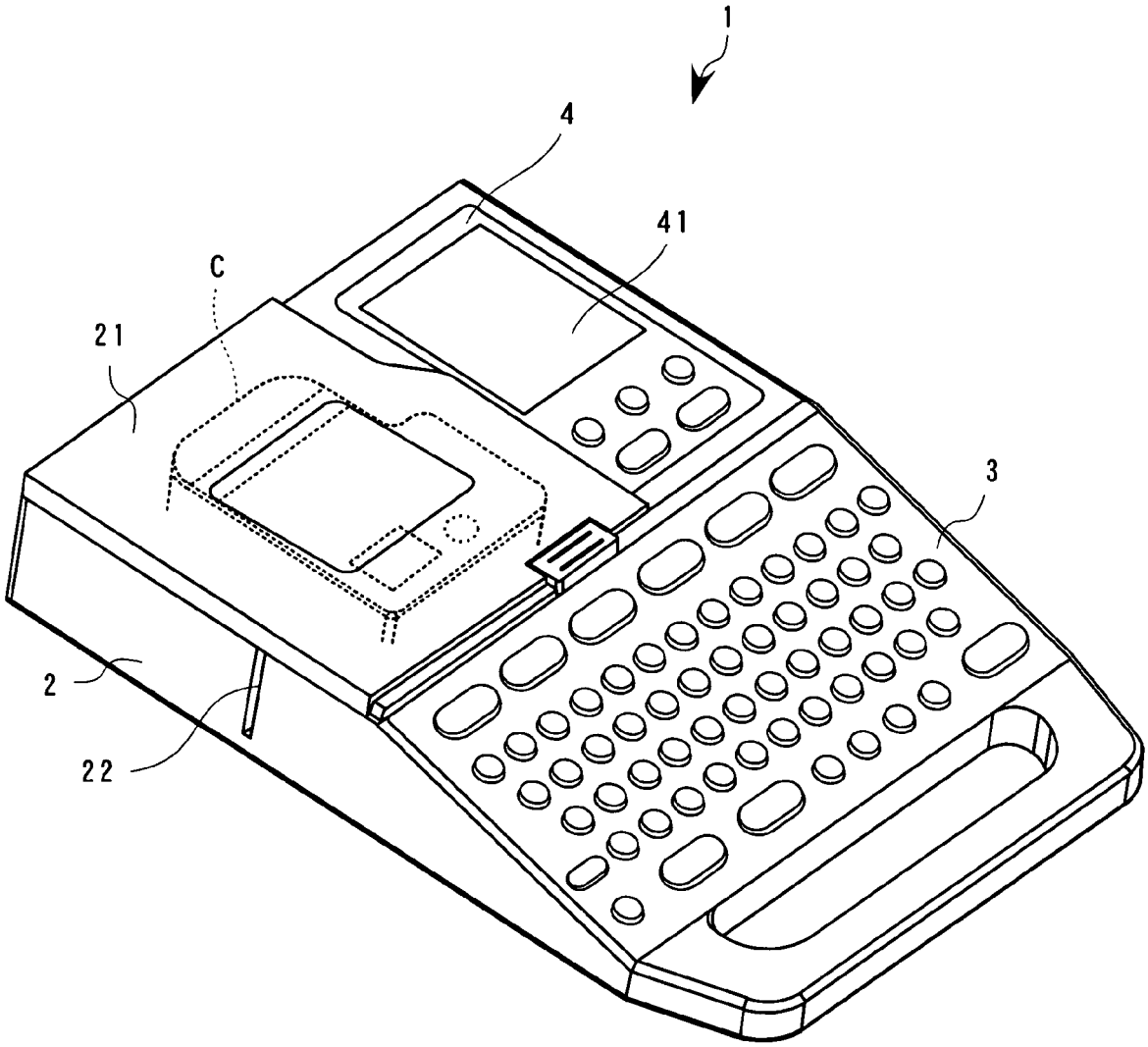
FIG. 1 is an external perspective view of a tape printing apparatus according to a first embodiment of the present invention.
Figure 2:
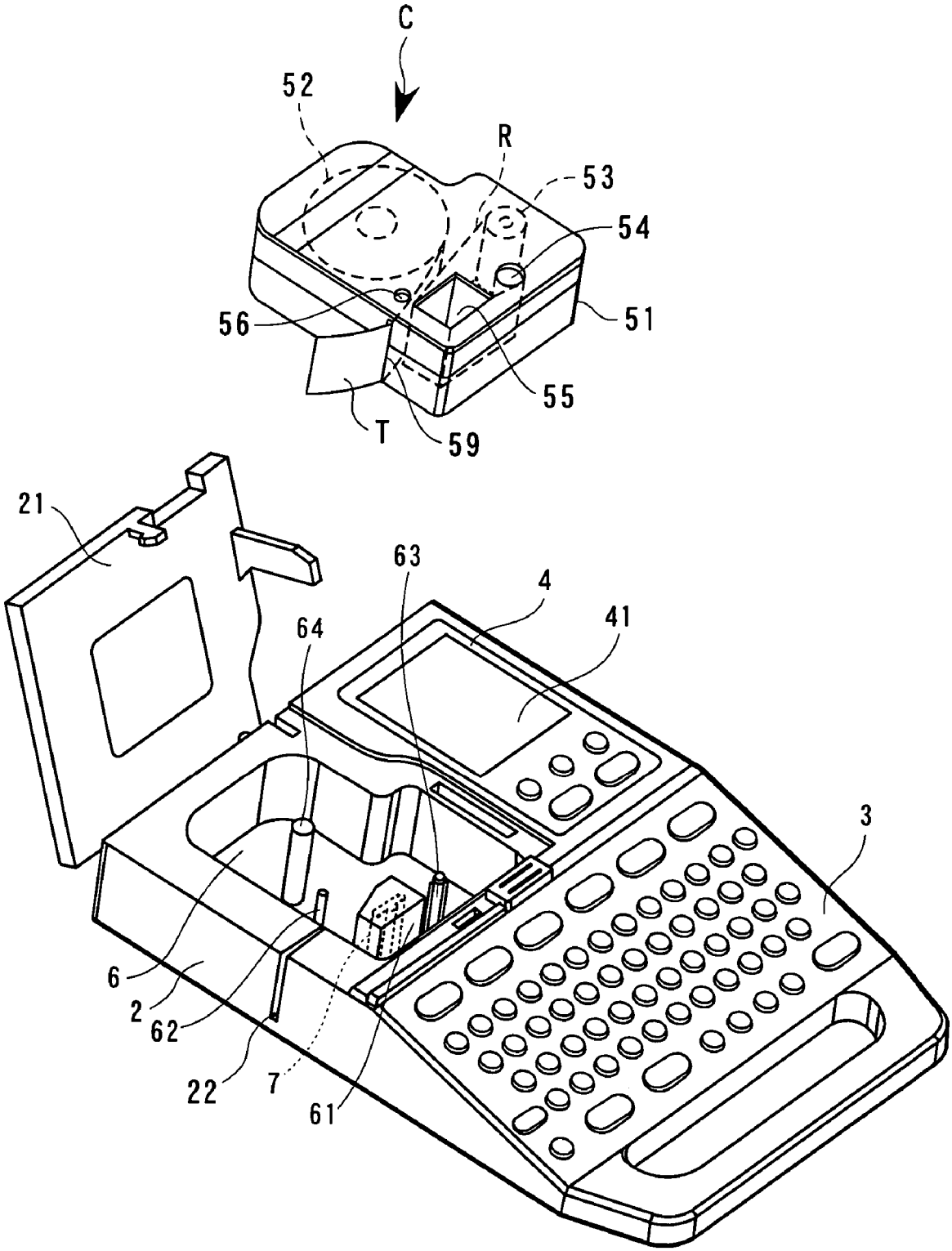
FIG. 2 is a perspective view of the tape printing apparatus of FIG. 1 in a state where a lid is opened.

As shown in FIGS. 1 and 2, in a tape printing apparatus 1, an outer shell of the tape printing apparatus 1 is formed by a printing apparatus case (printing apparatus body) 2, and a keyboard 3 including various entry keys is provided on the front top surface of the printing apparatus case 2. In addition, an opening/closing lid 21 is attached on the left side of the rear top surface of the printing apparatus case 2, and a display 4 is provided on the right side thereof. A pocket (tape mounting portion) 6 and a tape ejection opening 22 are formed on the left side of the printing apparatus case 2. The tape ejection opening 22 is in a slit shape and communicates with the outside of the printing apparatus. A tape cutter 132 (FIG. 3) is provided, facing the tape ejection opening 22, and cuts off a print tape T which is sent out (hereinafter, simply referred to as "tape").

Figure 3:
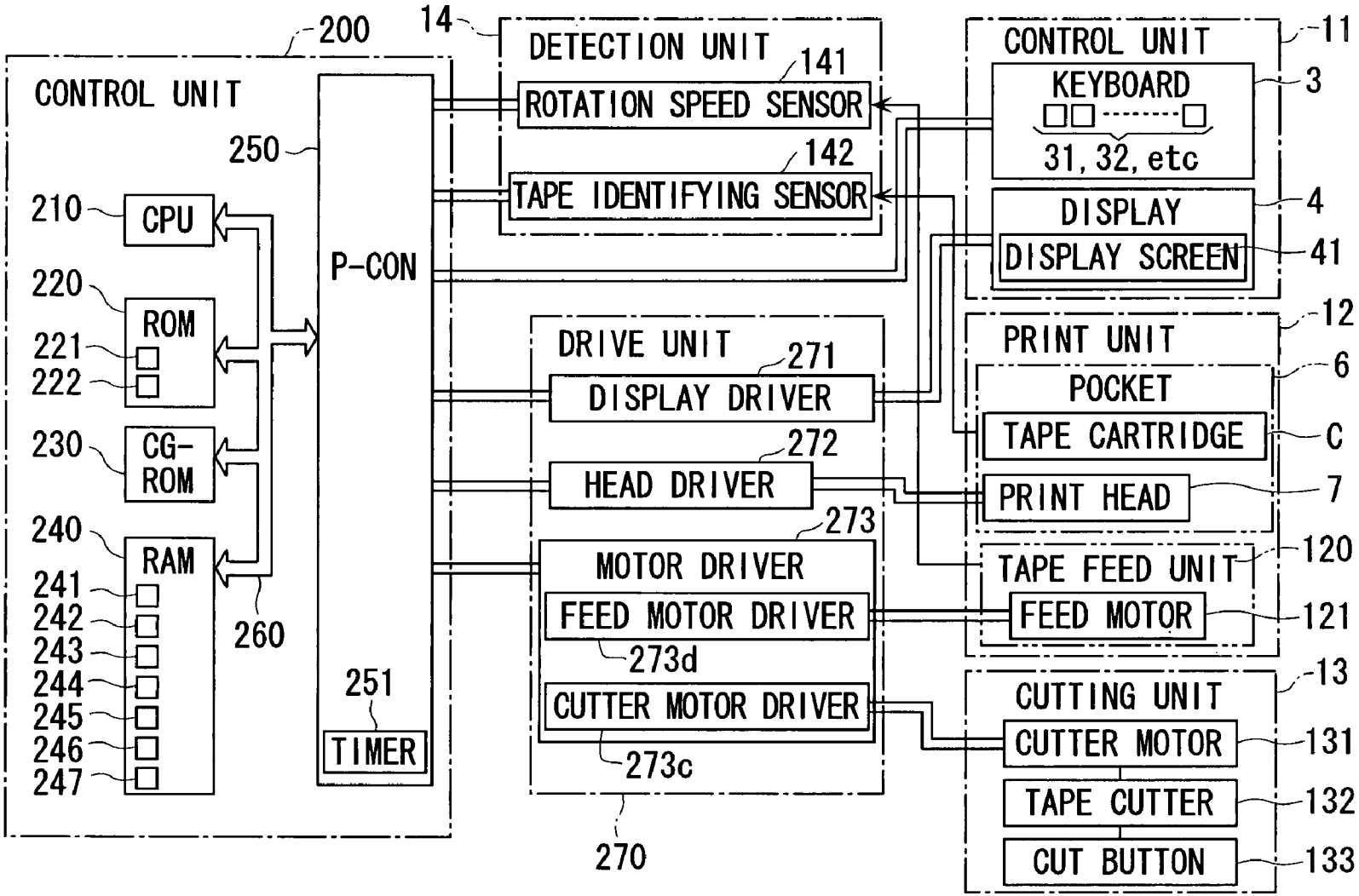
FIG. 3 is a block schematic diagram showing a control system of the tape printing apparatus of FIG. 1.

Further, as a basic construction, the tape printing apparatus 1 includes an operation unit 11, a printing unit 12, a cutting unit 13, a detection unit 14, a drive unit 270 and a control unit 200, as shown in FIG. 3. The operation unit 11 has the keyboard 3 and the display 4 and interfaces with a user. The printing unit 12 has a print head (thermal head) 7 and a tape feed section 120 and prints an image on the tape T in a tape cartridge C which is mounted within the pocket 6. The cutting unit 13 cuts off the tape T after printing. The detection unit 14 has various sensors and performs various detections. The drive unit 270 has various drivers and drives each circuit, and the control unit 200 controls each unit within the tape printing apparatus 1.

Other than the printing unit 12, the cutting unit 13, the detection unit 14 and the like, circuit boards (not illustrated) are stored within the printing apparatus case 2. Each circuit of the drive unit 270 and the control unit 200 in addition to a power source unit are mounted on these circuit boards and connected to a battery such as a nicad battery which is detachable from an AC adaptor connection port (not illustrated) or outside.

In the tape printing apparatus 1, after mounting the tape cartridge C onto the pocket 6, a user enters print information including a desired-letter (a character such as a letter, a number, a symbol and a simple diagram) by the use of the keyboard 3 while confirming the result of entry/edit on the display 4, and then the user instructs printing. Thereafter, the tape T is reeled out from the tape cartridge C by the tape feed section 120, and desired printing is carried out onto the tape T by the print head 7. A printed portion of the tape T is sent outside from the tape ejection opening 22 whenever necessary. Upon completion of desired printing, the tape feed section 120 stops sending out the tape T after sending the tape T until the length thereof including a margin is sent outside.

As shown in FIGS. 2 and 3, the printing unit 12 has the pocket 6 provided on the inner side of the opening/closing lid 21, for mounting the tape cartridge C thereon. The tape cartridge C is attached to/detached from the pocket 6 in an opened state of the opening/closing lid 21. Further, there are a plurality of small holes (not illustrated) provided on the back side of the tape cartridge C in order to be able to distinguish different types of tapes T having different width and the like. In the pocket 6, a tape identifying sensor 142, such as a microswitch is provided to detect these holes. Therefore, presence of the tape T (to be more precise, whether or not the tape cartridge C is mounted) and the kind of the tape T (to be more precise, the kind of the tape cartridge C) can be detected.

In the tape cartridge C, the tape T having a certain width (about 4.5 to 48 mm) and an ink ribbon R are housed, and a through opening 55 where the print head 7 faces is formed. The back surface of the tape T is formed to be adhesive and is covered with a release paper. Further, a platen roller (platen) 56 is housed at a position where the tape T and the ink ribbon R are overlapped, corresponding to the print head 7 built in a head unit 61. With the tape cartridge mounted thereon, the print head 7 attaches the back surface of the ink ribbon R which is exposed from the through opening 55, thereby driving the print head 7. Thus, the desired letter or the like is printed on the surface of the tape T.

In the pocket 6, a platen drive axis 62, a take-up drive axis 63 and a positioning pin 64 are erected. The platen drive axis 62 is engaged with and rotates the platen 57 using a feed motor 121 made of a DC motor as a drive source. Similarly, the take-up drive axis 63 is engaged with and rotates a ribbon take-up reel 54.

Once the tape cartridge is mounted onto the pocket 6, the head unit 61, the positioning pin 64, the platen drive axis 62 and the take-up drive axis 63 are inserted into the though opening 55, the tape reel 52, the platen 56 and the ribbon take-up reel 54, respectively. As the opening/closing lid 21 is closed in this state, the print head 7 is abutted on the platen 56 while sandwiching the tape T and the ink ribbon R therebetween, and the tape T and the ink ribbon R move in a mutually overlapped state at a position of the through opening 55. At the same time, the print head 7 is driven synchronously with the tape T and the ink ribbon R, thereby carrying out the printing. Thereafter, only the tape T is delivered outside of the tape cartridge C from a tape reel-out port 59 while the ink ribbon R is taken up inside. As the platen 56 continues to rotate (the ribbon take-up reel 54 synchronously rotates) for a predetermined period of time, the tape T is consecutively sent out. The tape T is sent outside the printing apparatus through the tape ejection opening 22 until a predetermined cutting position of the tape T come to the position of the tape cutter 132.

The tape feed section 120 is provided over a space from the side to the bottom of the pocket 6 and rotates the aforementioned platen drive axis 62 and the take-up drive axis 63 using the feed motor 121 arranged on the side of the pocket 6 as a power (drive) source. The tape feed section 120 includes the feed motor 121, the platen drive axis 62, the take-up drive axis 63, a speed reducing gear train (not illustrated) which transfers power from the feed motor 121 to the respective drive axes, and an encoder (not illustrated) for detecting the rotation of the feed motor 121. This encoder is fixed to the tip of the axis of a worm which is fixed to a main axis of the feed motor 121, and this disk-like encoder has four detection openings formed in a circumferential direction thereof.

A rotation speed sensor 141 of the detection unit 14 has a photosensor in which a light emitting element and a light receiving element are placed to face each other so that they face the detection openings of the aforementioned encoder. Light from the light emitting element is received by the light receiving element through the rotating detection openings, and blinking of the received light is converted into electricity. Thereafter, the electricity is outputted to the control unit 200 as pulse signals, and the rotation of the feed motor 121 is detected based on the number of the pulse signals.

The detection unit 14 includes the foregoing rotation speed sensor 141 and the tape identifying sensor 142. They need not be included in the detection unit 14 depending on an actual situation.

The cutting unit 13 includes a tape cutter 132, a cutter motor 131 and a cut button 133. The cutter motor 131 makes tape cutter 132 to conduct a cutting operation. The cut button 133 makes the tape cutter to conduct the cutting operation manually for arbitrary length printing. In the case of fixed length printing, the cutter motor 132 is automatically driven. Automatic/manual mode can be switched by mode setting.

The drive unit 270 includes a display driver 271, a head driver 272 and a motor driver 273. The display driver 271 drives the display 4 of the operation unit 11 based on a control signal outputted from the control unit 200 and in accordance with the instruction of the control unit 200. Similarly, the head driver 272 drives the print head 7 of the printing unit 12 in accordance with the instruction of the control unit 200. The motor driver 273 has a feed motor driver 273*d* which drives the feed motor 121 of the printing unit 12 and a cutter motor driver 237*c* which drives the cutter motor 131 of the cutting unit 13. The motor drive 273 similarly drives the respective motors.

The operation unit 11 includes the keyboard 3 and the display 4. The display 4 has the display screen 41 which is rectangle with a horizontal (X direction) line of about 6 cm×a vertical (Y direction) line of about 4 cm, and is capable of displaying display image data of 96 dots×64 dots within the rectangle. After the user enters the data from the keyboard 3, this display 4 is used when creating and editing print image data such as image data of a character string, visually recognizing the result of the print image data, and entering various commands, selection instruction and the like from the keyboard 3.

Arranged on the keyboard 3 are a character key group 31, a function key group 32. The character key group 31 includes an alphabet key group, a number key group, a kana key group for hiragana and katakana characters, an external character key group for calling and selecting external characters, and the like. The function key group 32 is for specifying various operation modes and the like and includes a power key, a print key for instructing a printing operation, a selection key, four cursor keys and the like. The selection key is for defining data and feeding a line when entering a text and for selecting and instructing various modes on a selection screen. The four cursor keys are for moving a cursor in vertical and horizontal directions and for moving a display range of the display screen 41. Those keys mentioned above may be individually provided and used for each entry. Alternatively, a smaller number of keys may be used for entry by using a combination of those keys and a shift key and the like.

With the keyboard 3, various instructions and data can be inputted to the control unit 200. The control unit 200 includes a central processing unit (CPU) 210, a read-only memory (ROM) 220, a character generator ROM (CG-ROM) 230, a random-access memory (RAM) 240 and a peripheral control circuit (P-CON) 250, and they are connected to each other through an internal bus 260.

The ROM 220 has a control program area 221 which stores a control program to be processed in the UPU 210 and a control data area 222 which stores a control data including a color conversion table, a character modification table, a strobe width coefficient table which is described later, and the like. The CG-ROM 230 stores font data of characters and the like (including numbers, symbols, diagrams and the like) prepared in the tape printing apparatus 1. When code data which specify a character or the like is given, the CG-ROM outputs font data which correspond to the code data.

The RAM 240 is backed up for the time when the power is off. Various flag register group 241, a text data area 242, a display image data area 243, a print image data area 244, a rendering registration image data area 245, an external character registration image data area 246, and various buffer areas 247 such as a character expansion buffer and printing buffer. The RAM 240 is used as a work area for control processing.

A logic circuit constructed by a gate array, a custom LSI and the like is incorporated in the P-CON 250. The logic circuit helps the function of the CPU 210 and treats interface signals with the peripheral circuit. For example, a timer 251 which carries out clocking variously is incorporated as a function of the P-CON 250. Therefore, the P-CON 250 is connected to various sensors of the detection unit 14 and the keyboard 3, and the aforementioned various detection signals from the detection unit 14 and various commands and entry data from the keyboard 3 are fetched into the internal bus 260 as they are or after being processed. At the same time, while interlocking with the CPU 201, the P-CON 250 outputs the data and control signals, which are outputted from the CPU 210 and the like to the internal bus 260, to the drive unit 270 as they are or after processing them.

Thereafter, with the above-described construction, the CPU 210 inputs various detection signals, instructions, data and the like through the P-CON 250 following the control program within the ROM 220. The CPU 210 then processes the font data from the CG-ROM 230 and various data and the like within the RAM 240 and outputs the control signals to the drive unit 270 through the P-CON 250. Thereby, the position control for printing and display control of the display screen 41 and the like are performed and, at the same time, the print head 7 is controlled to print an image on the tape T under predetermined printing conditions. Accordingly, the CPU 210 controls the entire tape printing apparatus 1.

Figure 4:
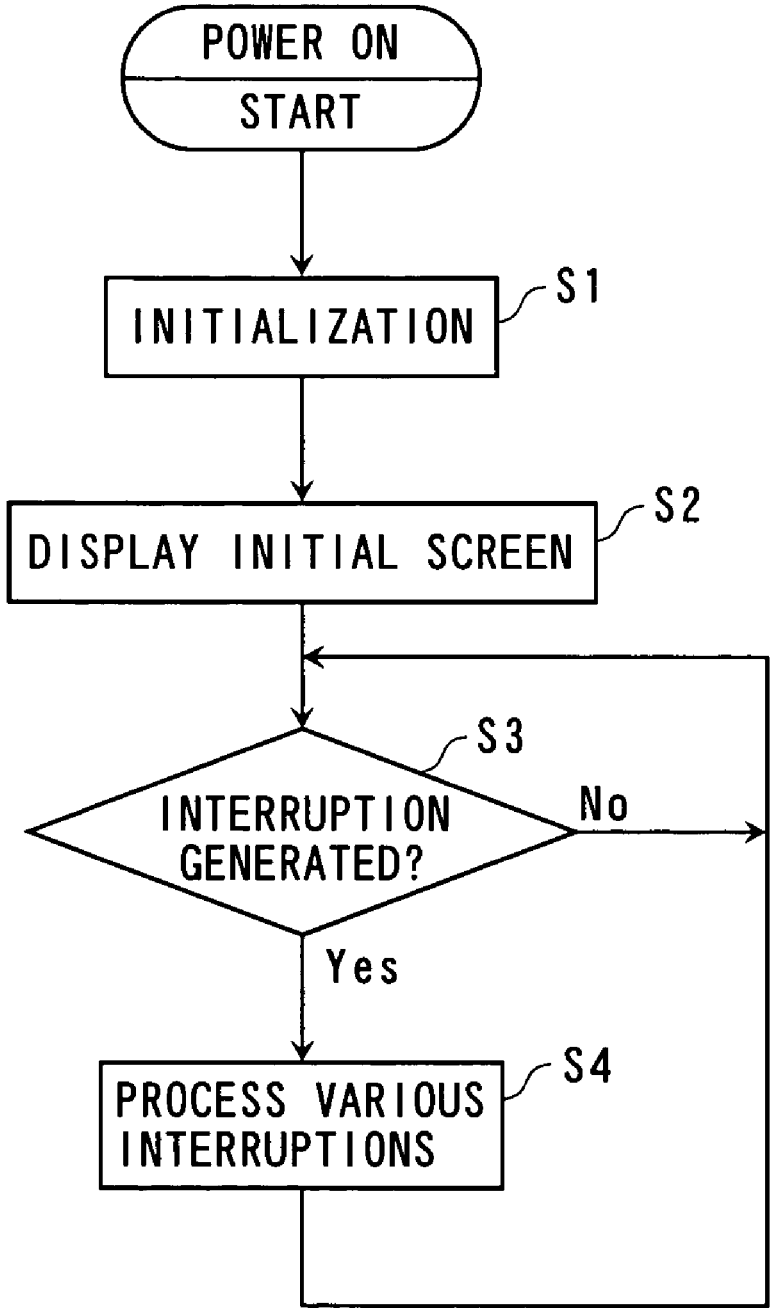
FIG. 4 is a flow chart showing an outline of the entire control processing of the tape printing apparatus.

Next, a process flow of the entire control of the tape printing apparatus 1 is described with reference to FIG. 4. As shown in FIG. 4, once processing starts by depressing the power key (power ON), initialization is performed (S1) such as recovery of each control flag which has been saved in order to recover the state of previous power off. Next, the previous display screen is displayed as an initial screen (S2).

The subsequent processing shown in the drawing, i.e. decision branch (S3) regarding whether or not there is a key entry and various interruption processing (S4), are conceptually shown. In practice, in the tape printing apparatus 1, once the initial screen display (S2) is finished, an interruption by a key entry and other ways is permitted, and the status is maintained as it is until some interruptions are generated (S3: No). When some interruptions are generated (S3: Yes), the step moves to each interruption processing (S4). Once the interruption processing is completed, the status is maintained again (S3: No).

As set forth above, the tape printing apparatus 1 performs main processing by the interruption processing. Therefore, if print image creation and the like are prepared, an interruption of print processing is generated once the user depresses the print button at an arbitrary point of time. Thereafter, the print processing is started, and printing of the print image is enabled based on the print image data. Specifically, the user can arbitrarily select operation procedures before printing is started.

Figure 5:
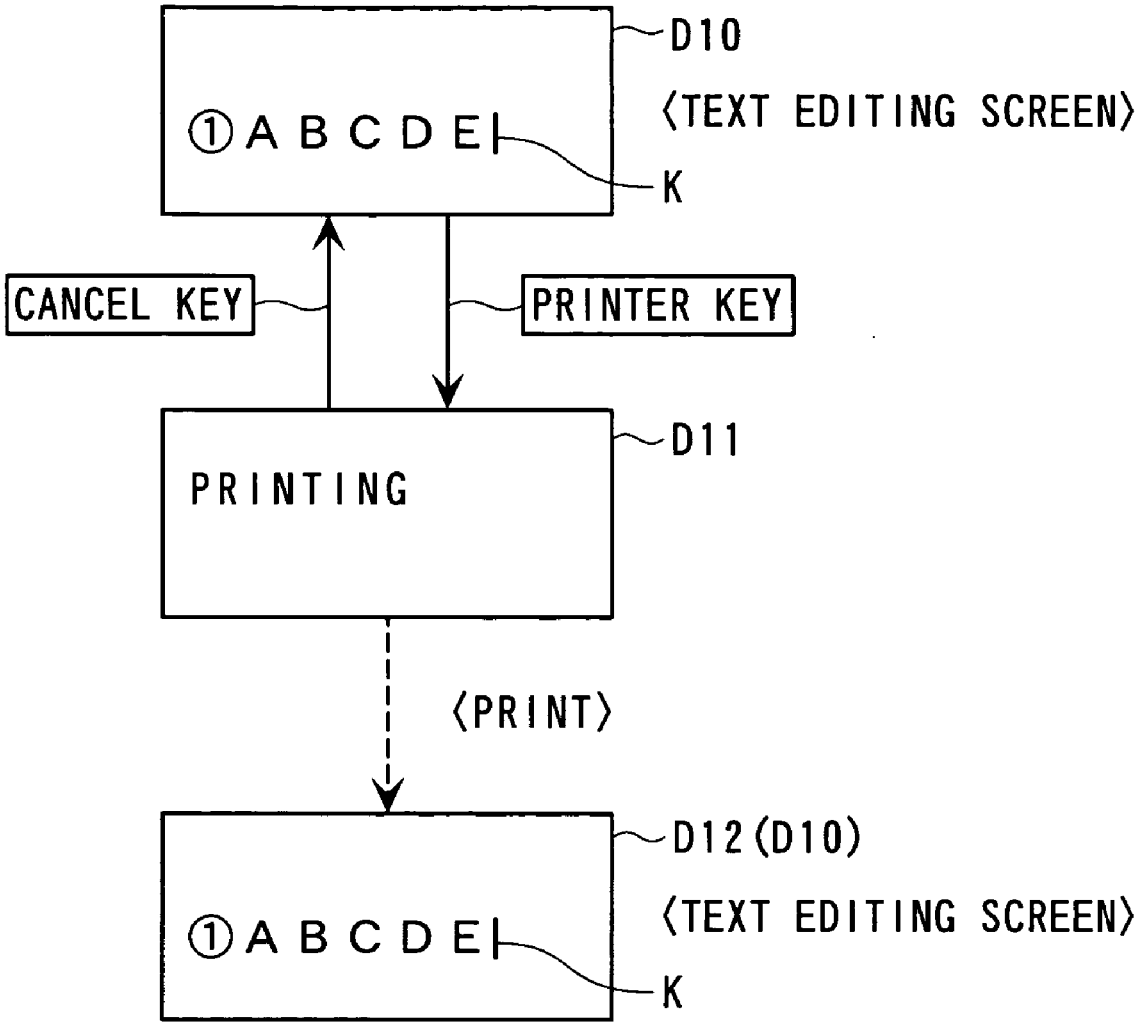
FIG. 5 is an explanatory view showing an example of a display screen and typical operations on the display screen when printing.

For example, as shown in FIG. 5, if the user depresses the print key in a state of a text editing screen display after a character string "A B C D E" up to a cursor K on the first line is entered (screen D10), a character string image of the character string "A B C D E" is printed as a print image G0 (see FIGS. 7 to 11) together with a massage displaying "printing" (D11). When the printing is completed, the screen returns to the original text editing screen (D12 which is same as D10). In the tape printing apparatus 1, the user can use a cancel key to cancel various instructions by key entries. Thus, by depressing the cancel key in the above state (D11), the screen can be returned to the display state of the original text editing screen (D10).

Figure 6A:
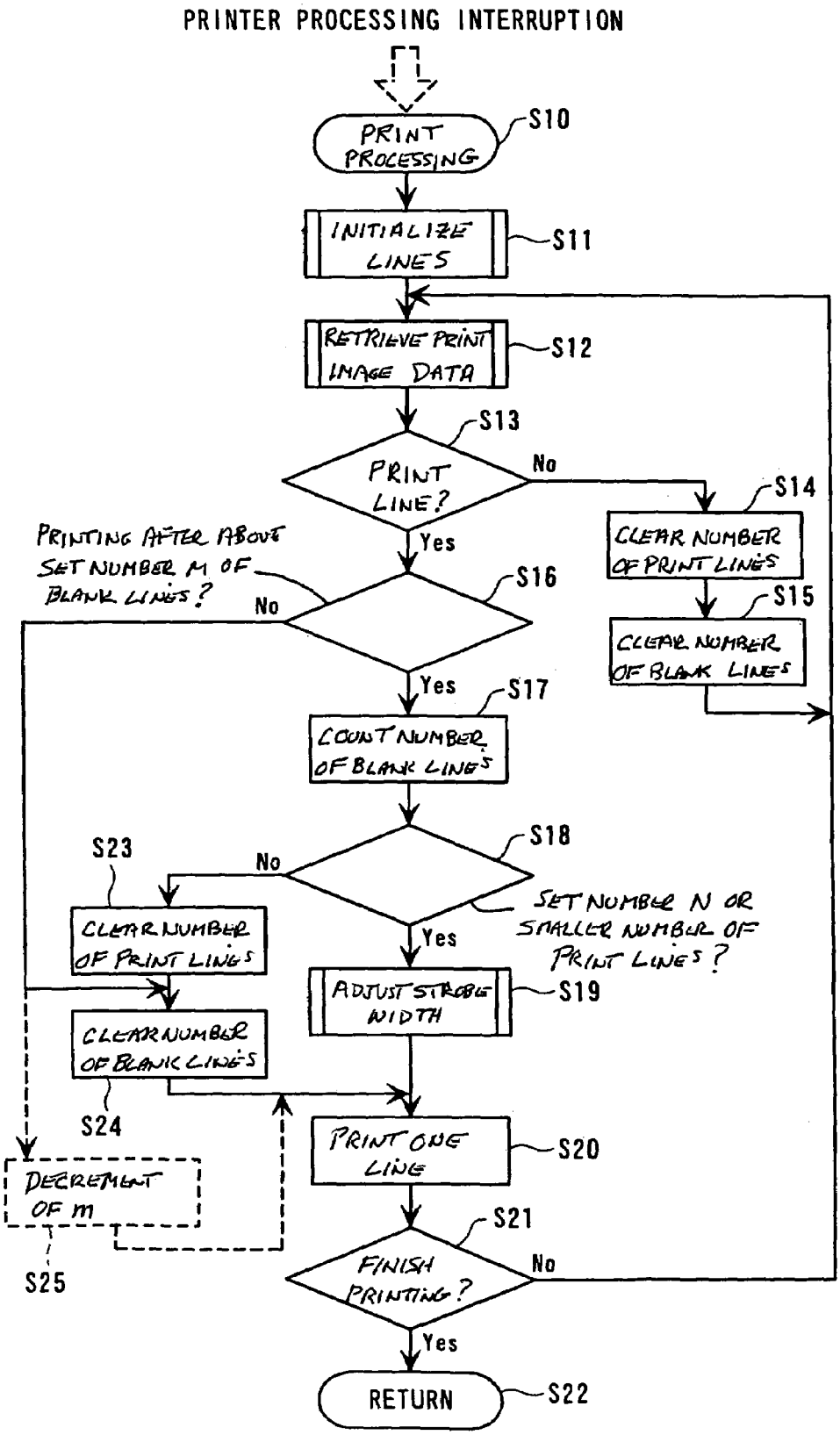
Figure 7:
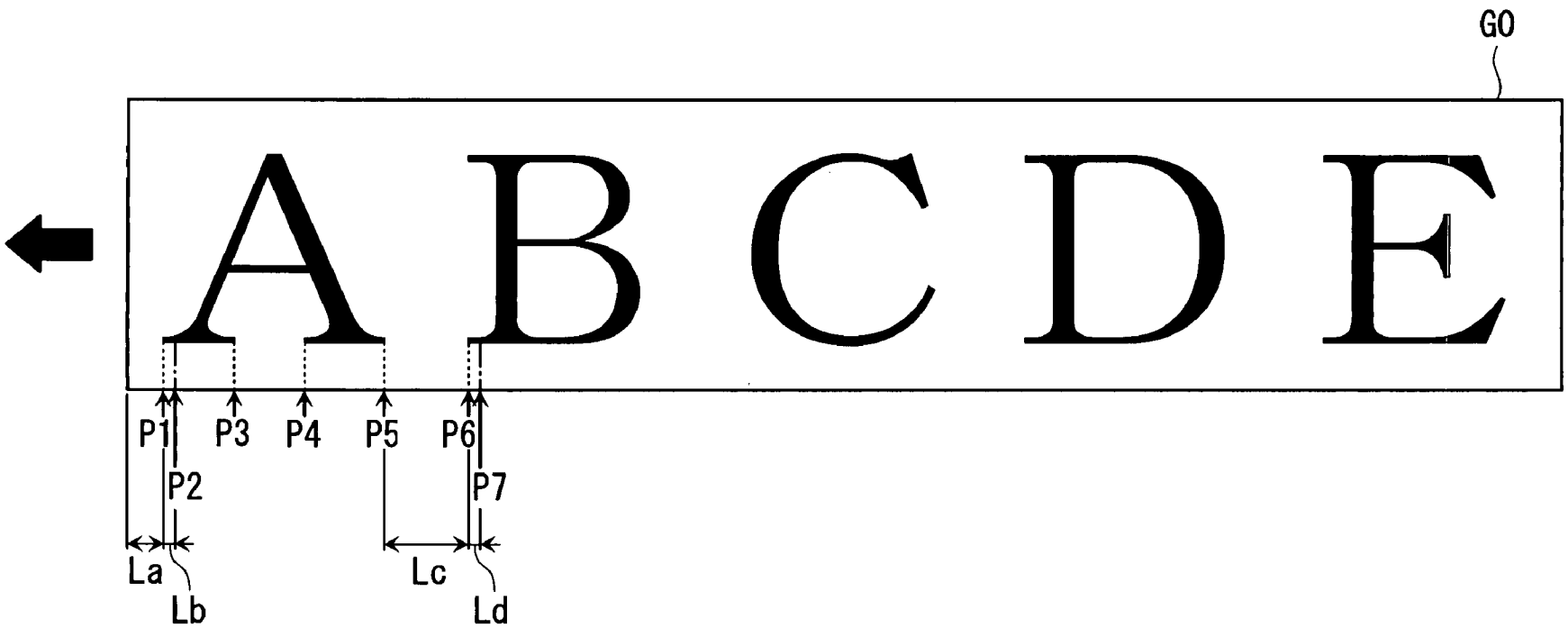
FIG. 7 is an explanatory view showing an example of a print image as a print result.

The aforementioned print processing is further detailed hereinbelow. In the following description, the foregoing print image G0 is used as an example. Once the user depresses the print key, the print processing interruption is generated and the massage "printing" is displayed (D11). At the same time, as shown in FIGS. 6A and 6B, the print processing (D10) is started. Before detailing the print processing (print control or heating control), the outline thereof is principally described.

First of all, dot rows made up of dots, that is, dot rows arranged in the tape-width direction are defined as dot lines. The dots are simultaneously printed by heating elements of the print head 7. For example, as shown in FIGS. 7 to 10, in the case of printing the foregoing print image G0 of "A B C D E", the dot lines are printed one by one using heating elements provided in a row of the print head 7 while sending the tape in a bold arrow direction in FIG. 7 (longitudinal direction of the tape T: relative moving direction). Thus, each of the dot lines of a dot matrix which constructs the characters such as "A" are sequentially printed.

In the case of a high resolution (high print density), a line equivalent to one dot line in the print image data may be divided for printing. In that case, however, the number of the dot lines is considered equivalent to the number of divided dot lines. For example, when one line with 256 dots are printed as 64 dots×4 times, the line with 256 dots are treated as four dot lines based on the idea that "dot rows made up of dots that are simultaneously printed are considered to be one dot line." When the line with 256 dots is printed at once (simultaneously), the line is treated as one line.

In addition, a dot line which does not include dots to be printed ("dots" mean those to be printed by heating the respective heating elements of the print head 7: pixels to be printed: illustrated black dots) is defined as a "blank line" (or white line: WL). The blank line is exemplified by La number of dot lines (the line number of dot lines is La) from the head of the print image G0 to the head position P1 of the character "A." On the contrary, a dot line including dots to be printed (illustrated black dots) is defined as a "print line" (or black line: BL) such as dot lines from the head position P1 of the character "A" to an end position P5 thereof. In addition, the number La of the first blank lines in the print image G0 is set to be La≧10.

Figure 13:
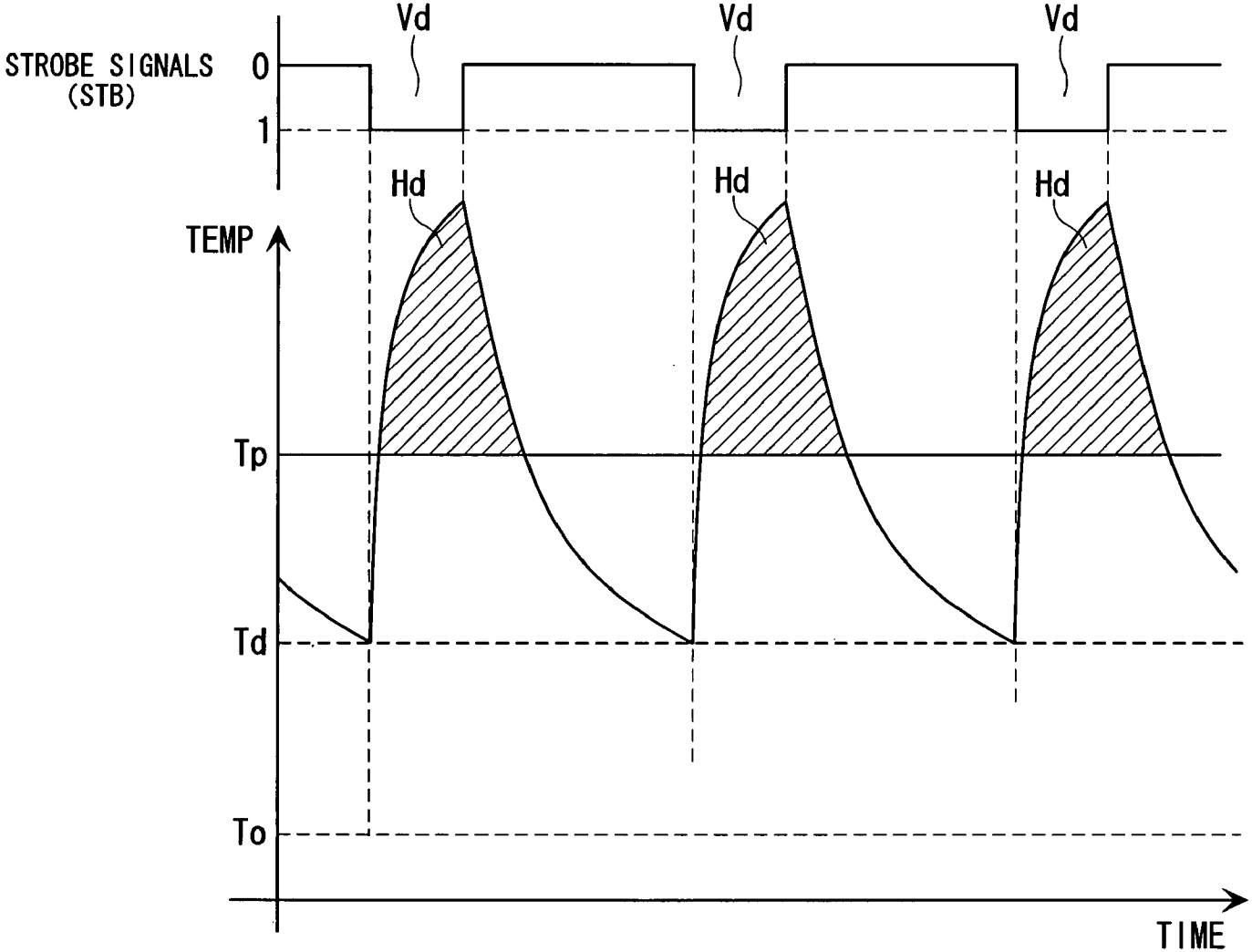
FIG. 13 is an explanatory view showing an image of the strobe signals with standard strobe widths under a steady state and the heat accumulation controlled by the standard strobe signals.

Here, as shown in FIG. 13, the print head 7 immediately before printing the print line is heated to a temperature Td (the minimum temperature required to start printing) which is sufficiently higher than an ambient temperature (environment temperature) T0, that is, the print head 7 has sufficient heat accumulation. In this case, when strobe (STB) signals Vd with standard (reference) strobe widths are applied, a sufficient heat quantity Hd can be obtained as an amount of accumulated heat (applied energy by Joule heat) of portions with the minimum temperature (minimum print temperature) Tp or higher temperature required for printing.

Figure 11A:
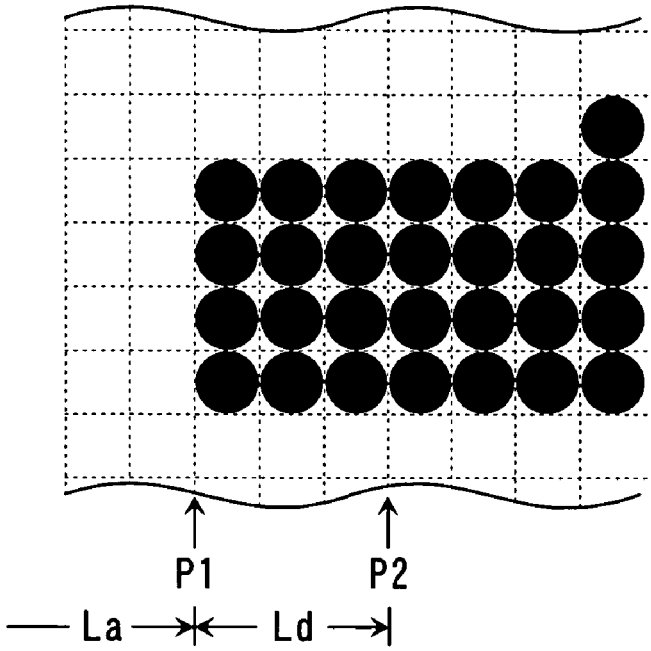
FIGS. 11A and 11B are explanatory views showing an image in a desired state and an image depicting a conventional problem, with regard to printing of a print line that follows consecutive blank lines.
Figure 11B:
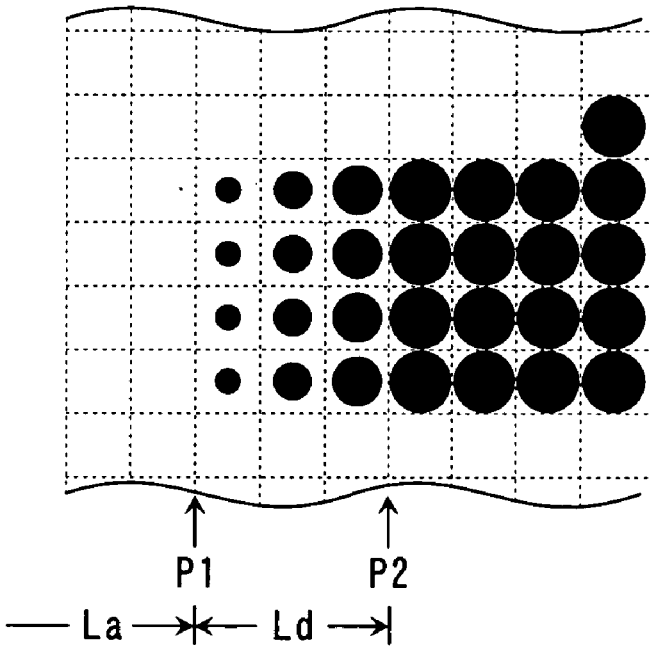
Figure 15:
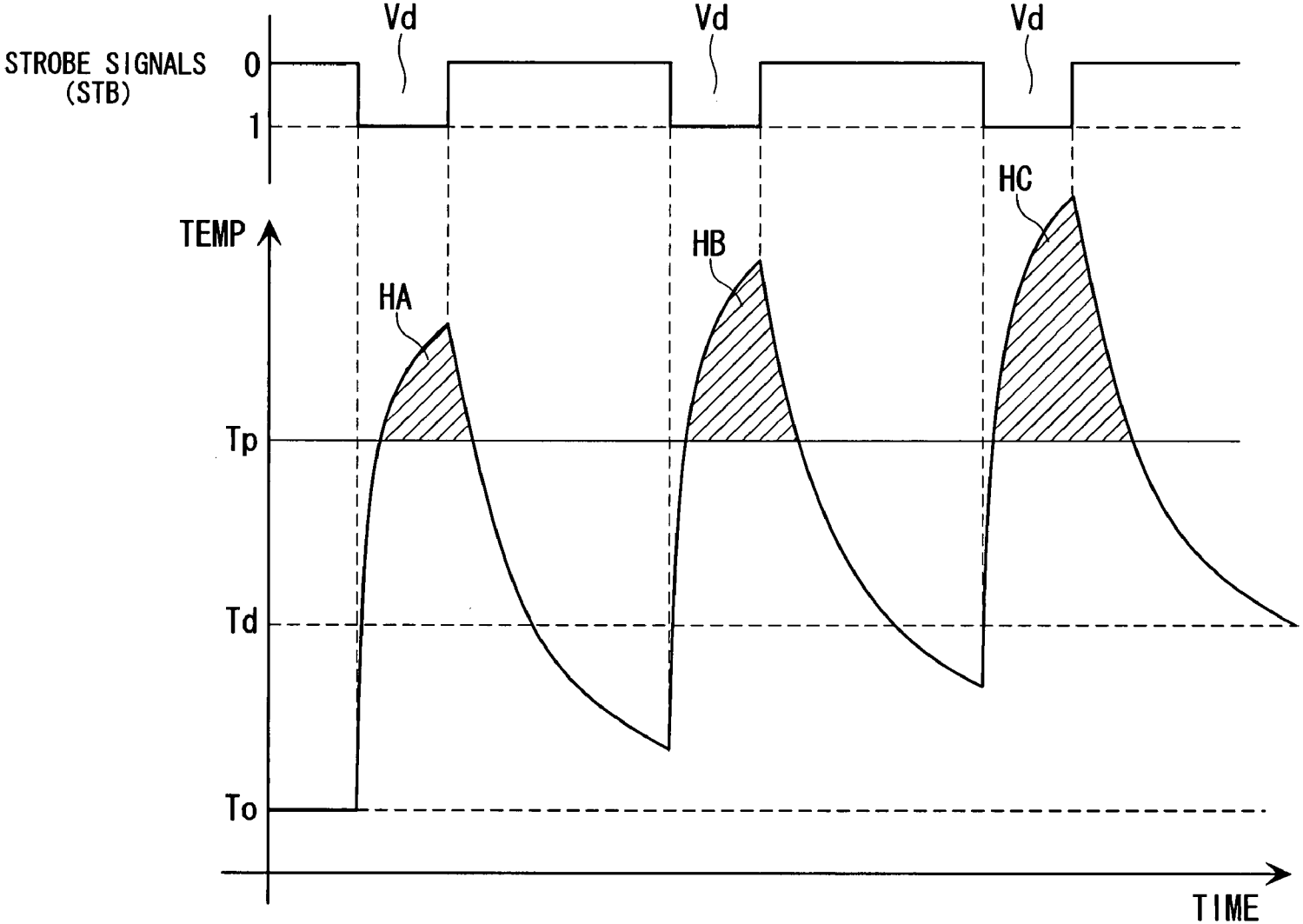
FIG. 15 is an explanatory view showing an image of the strobe signals with the standard strobe widths after the consecutive blank lines and an image of a problem regarding the heat accumulation controlled by the strobe signals.

On the contrary, there is a case where the print lines are left for a while, or a case where consecutive blank lines above (or more than) a predetermined number of consecutive blank lines are present, i.e., as shown in FIG. 15, the print head 7 immediately before printing the print line is cooled down to about the ambient temperature T0. In this case, even if the strobe (STB) signals Vd are applied with standard strobe widths similar to above, sufficient heat quantity for printing is not obtained, and the heat quantity to be provided becomes heat quantities HA, HB, HC or the like, as illustrated. Therefore, even if the printing is desired to be performed as shown in FIG. 11A, the heat quantity (printing energy) for printing each pixel (each black dot) of the image becomes short (or insufficient), and sizes of the dots are reduced as shown in FIG. 11B, thus deteriorating the image quality.

In the print processing (S10) of this embodiment shown in FIGS. 6A and 6B, the following conditions are exemplified. Namely, the print line is printed (S13: Yes), and the number of the blank lines before printing is determined to be not less than (or more than, or above) a set number M of blank lines (M≦m) (S16: Yes), and the number of the print lines that have been printed does not continue for the set number N of blank lines (N≦n) (S18: Yes). In other words, the conditions are as follows. Namely, the printing is started from the state in which the print head 7 has cooled down to about the ambient temperature T0, and the printing has not been conducted enough to recover a sufficient heat quantity (both S16 and S18: Yes). Under these conditions, the adjustment of the applied energy is carried out by adjusting the strobe width (S19), and then one line (print line) to be printed is printed (S20).

Figure 12:
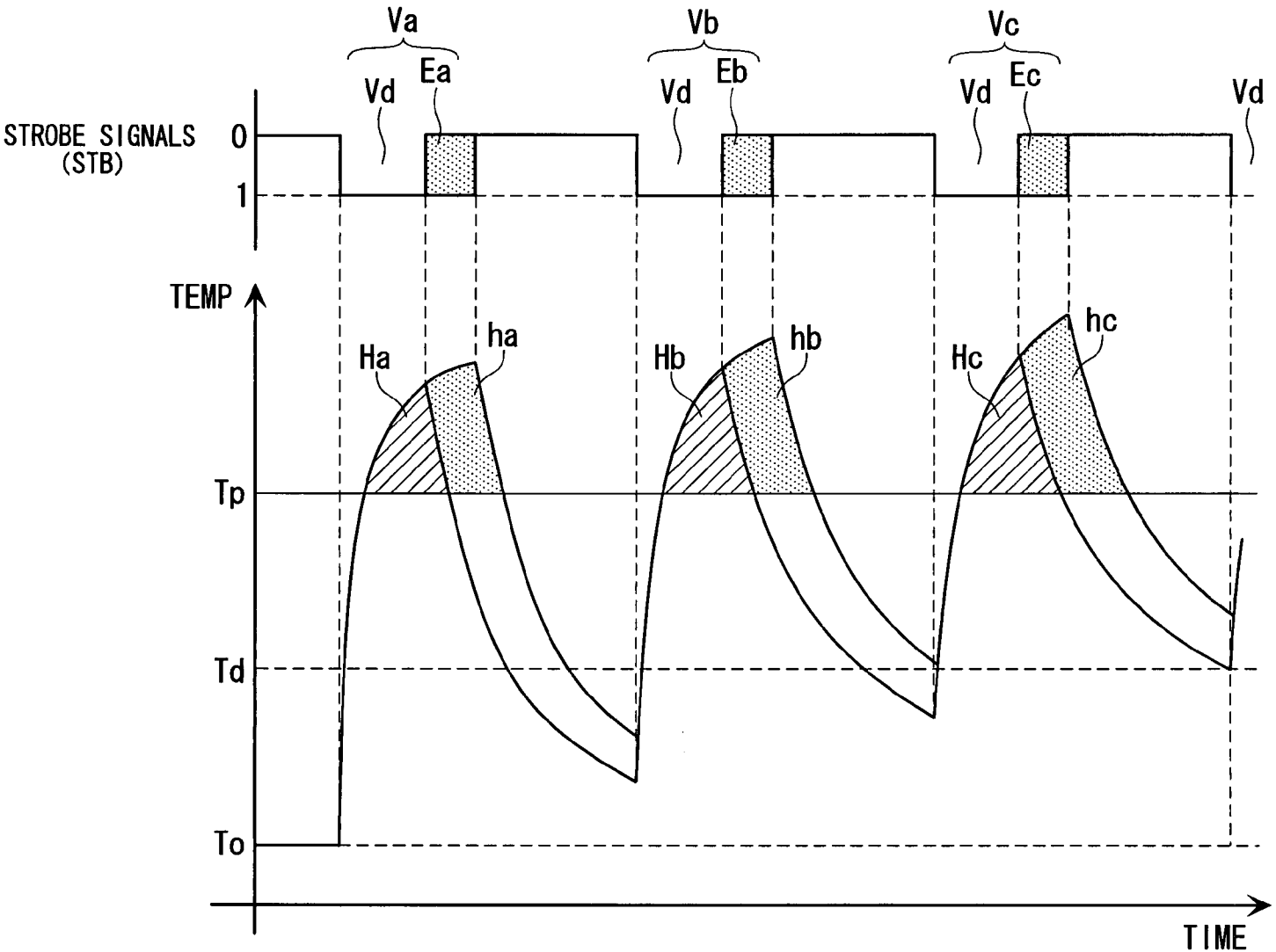
FIG. 12 is an explanatory view showing an image of strobe signals whose strobe widths are adjusted after the consecutive blank lines and an image of heat accumulation controlled by the adjusted strobe signals.

To be more specific, coefficients for multiplying the standard strobe widths are stored in a coefficient table and the like within the ROM 220, and the coefficient is read out to multiply the standard strobe width to obtain a special strobe width. For example, as shown in FIG. 12, the strobe signals Vd with the standard strobe widths are increased by illustrated widths of Ea, Eb and Ec to obtain strobe signals Va, Vb and Vc to be applied (S19). In this case, heat quantities ha, hb and hc obtained by the increased widths Ea, Eb and Ec are added to the heat quantities of Ha, Hb and Hc which are the widths without increasing thereof. Consequently, the amount of accumulated heat (applied energy) is adjusted and thus the heat quantities required for printing are ensured. Values of the respective widths Ea, Eb and Ec (or the values of the coefficients for multiplication) may be equal to each other (Ea=Eb=Ec), or may be, for example, gradually reduced (Ea>Eb>Ec) (in the illustrated example, the values are set to be Ea≧Eb≧Ec).

Hereinbelow, the details are described along the processing flow. As shown in FIG. 6A ns 6B, once the print processing (S10) is started, the number m of consecutive blank lines (WL) is initialized (to be m=0) first, and the number n of consecutive print lines (BL) is initialized (to n=0) (S11). A threshold (set number of the blank lines) M of the number m of consecutive blank lines (WL) until the print head 7 is cooled down by heat dissipation is set to ten (M=10). In addition, a threshold (set number of the print lines) N of the number n of consecutive print lines (BL) until the amount of accumulated heat of the print head 7 is returned (recovered) to a steady state by printing is set to three (N=3) to meet FIG. 12. As a matter of course, these values can be arbitrarily set based on actual data or the like.

Upon completion of each initialization (S11), the print image data is retrieved and the first dot line (herein after, abbreviated as "line" as appropriate) is analyzed to be prepared for the printing (S12). Thereafter, it is determined whether or not the prepared line is the "print line" (S13). In the example of the print image G0, the first line is the "blank line" (S13: No). Next, the number n of consecutive print lines (BL) is cleared to be zero (n←0) (S14: the reason for this clearing is described later), and the number m of consecutive blank lines (WL) is counted (m←m+1). When the number m of consecutive blank lines is zero (m=0) in the initialized state as above, the number m becomes one (m=1) based on m←m+1=1 (S15).

Next, the print image data is retrieved, and the next line is analyzed to be prepared for printing (S12) and similarly determined whether or not it is the print line (S13). Since the line is the "blank line" as before (S13: No), the number n of consecutive BL is cleared (S14) and thereafter the number m of consecutive WL is counted. This time, the number m is two (m=2) based on m←m+1=2 (S15). Similarly the lines until the La-th line are analyzed (see FIGS. 7 to 10) and determined to be the blank lines in the similar manner to the above. Thereafter, the number m of consecutive blank lines (WL) becomes La (m=La) (S15). At this point, analysis of the La numbers of the lines between the first to the La-th line (to the position P1) are finished.

Next, the print image data is retrieved and the next line is analyzed and prepared (S12) and then determined whether or not it is the print line (S13). The next line (the line immediately after the position P1: La+the first line) is the print line (S13: Yes). Therefore, it is determined whether or not the number of print line to be printed from now is printed after above (or mote than) the set number M of blank lines (i.e. M≦m or not) (S16). Here, since the number m is m=La≧10(=M), the number of blank lines before the printing is above the set number M of blank lines (M≦m) (S16: Yes).

Once it is determined that the printing is carried out after above the set number M of the blank lines (M≦m) (S16: Yes), the number n of consecutive print lines (BL) is counted (n←n+1). Since the number n is zero (n=0) in the initialized state as described earlier, the number n becomes one (n=1) based on n←n+1=1 (S17). Next, it is determined whether or not the print line to be printed from now is printed after above the set number N of consecutive print lines (i.e. N≦n or not) (S18). Here, since the number n is n(=1)≦N(=3), the number of print lines before the printing is below the set number N of print lines (N≧n) (S18: Yes). Therefore, the strobe width (applied energy) is adjusted (S19) and then the printing of the first line after the La number of lines (La+the first line) is finished by applying the strobe signal Va (see FIG. 12) (S20). Next, it is determined whether or not the printing is completed, i.e., processing of the last line of the print image G0 is finished (S21).

Here, the printing is not completed yet (S20: No). Hence, the next print image data is retrieved and the next line is analyzed and prepared (S12). The next line which is the second line after the La number of lines (La+the second line) is also the print line and printed after above the set number M of blank lines (M≦m). The number n of consecutive BL is counted and the number n is two (n=2). Since the number n is n(=2)≦N(=3) which is below the set number N of the print lines (N≧n) (S13 to S16 to S17 to S18), adjustment of the applied energy is carried out by adjusting the strobe width (S19). Thereafter, printing of the second line after the La number of lines (La+the second line) is finished by applying the strobe signal Vb (S20), and it is then determined whether or not the printing is completed (S21).

As for the next line (La+the third line), the number n is three (n=3) which is obtained in a similar manner. Since the number n is n(=3)≦N(=3) (S13 to S16 to S17 to S18: Yes), the strobe width (applied energy) is adjusted (S19). Thereafter, printing of the third line after the La number of lines (La+the third line) is finished (S20) and it is then determined whether or not the printing is completed (S21).

Similarly, the next line (La+the fourth line) is the print line (S13: Yes) and there are more than (or above) the set number M of blank lines (M≦m) before printing (S16: Yes). The number n of consecutive BL is counted, and the number n is four (n=4) (S17).

However, since the number n is n(=4)>N(=3), the number of the print line before printing is no longer within the set number N of print lines (S18: No). Next, the number n of consecutive BL is cleared (n←0) (S23), and then the number m of consecutive WL is cleared (m←0) (S24). Thereafter, the strobe signal Vd without an adjusted strobe width (i.e. with the standard strobe width) is applied to finish printing the fourth line after the La number of lines (La+the fourth line) (S20). Next, it is determined whether or not the printing is completed (S21).

In the case of the print image G0, the printing is not finished (S21: No). Therefore, the next line (La+the fifth line) is analyzed similarly (S12), and determined to be the print line (S13: Yes). However, the number m of consecutive WL is cleared (m=0). Therefore, it is determined that the printing is not the printing after above the set number of the blank lines M (M≦m)(S16: No). Next, the number m of consecutive WL is cleared (m←0) (S24: the reason of this clearing is described later), and then printing of the fifth line after the La number of lines (La+the fifth line) is finished by applying the strobe signal Vd with the standard strobe width (S20). Thereafter, it is determined whether or not the printing is completed (S21).

Subsequently, the next line (La+the sixth line) and the following lines are processed in a manner similar to the fifth line after the La number of lines (La+fifth line) (a loop processing of S12 to S13 to S16 to S24 to S20 to S21 to S12). Specifically, the La number of lines up to the position P1 is not printed because they are the blank lines (WL) whereas three (=N) lines Lb (=N) between the positions P1 and P2 are printed by applying the strobe signals Va, Vb and Vc with adjusted strobe widths (applied energy). The lines between the positions P1 and P5 are printed by applying the strobe signals Vd with standard strobe widths without adjustment. At this point, printing of the character "A" out of the character image "A B C D E" of the print image G0 is finished.

The printing is not completed (S21: No) at the point when the printing of the lines up to the position P5 of the print image G0 is finished. Therefore, the next line is similarly analyzed (S12). The lines between the positions P5 and P6 are not printed as they are the blank lines (WL). The number M becomes M≦n (=Lc) by processing the lines between the positions P5 to P6 (a loop processing of S12 to S13 to S14 to S15 to S12), and the number of the blank lines before printing is above the set number M of blank lines (M≦m) (S16: Yes). Thus, the three (=N) lines Ld (=N) between the positions P6 and P7 are printed by applying the strobe signals Va, Vb and Vc with adjusted applied energy. The following lines are printed by applying the strobe signals Vd with the standard strobe widths and the similar processing is continued. Thus, printing of the entire character image "A B C D E" of the print image G0 is completed (S21: Yes). Thereafter, the print processing (S10) is finished (S22) and the screen returns to the original text editing screen (D12 in FIG. 5).

As set forth hereinabove, in the tape printing apparatus 1 of this embodiment, the energy to be applied to the print head 7 is adjusted in order to print each of the print lines based on the number m of consecutive blank lines (WL) and the number n of consecutive print lines (BL), which are consecutively present in a longitudinal direction of tape T. Thus, the image quality degradation can be prevented in accordance with the content of the print image. Further, in this embodiment, adjustment of the applied energy is carried out by adjusting the strobe widths of the strobe signals (strobe pulses) to be applied to the print head 7, and adjustment of the application duration can be carried out by adjusting the strobe widths. Hence, the applied energy can be adjusted even though the applied voltage and the applied current to be provided by unit time remain unchanged.

To be more specific, when there is above the set number M of blank lines and the lines following these blank lines are printed, the applied energy is increased to exceed the reference value. Therefore, a sufficient heat quantity can be provided to the print head 7 whose amount of accumulated heat is insufficient due to heat dissipation because of the consecutive blank lines. Thus, image quality degradation due to the lack of heat quantity can be prevented. Moreover, when printing the print lines after above the set number N of print lines are consecutively present, the energy which is applied to the print head 7 is returned to the standard value, judging that the print head 7 has a sufficient amount of accumulated heat supplied with the increased applied energy. Therefore, excessive heating and image quality degradation thereby can be prevented.

In the example of the print image G0 described earlier, lines between the first line after the La number of lines (La+the first line) and the forth line after the La number of lines (La+the fourth line) are consecutively present as the print lines, for example. Hence, adjustment of the applied energy is omitted for the fourth print line after the La number of lines (La+the fourth line) based on the fact that the number n thereof is four (n=4), judging that sufficient heat is already accumulated therein. In the foregoing print processing (S10), however, when the second, third or the fourth line after the La number of lines (La+the second, third or fourth line) is a blank line, for example, the number n is counted again. Specifically, when there is this type of blank line (S13: No) the number n of consecutive print lines (BL) is cleared (n←0) (S14).

In the above case, however, one to three print lines (=1 to N lines) are printed temporarily, and heat is accumulated by printing (heating) the lines. Therefore, this is not the same as the case where heat is radiated because only the blank lines are consecutively present. Thus, considering the accumulated heat, the number n of consecutive print lines (BL) may be cleared after the number n is decremented to zero. Specifically, the number n may be set to [n←n−1 (in the case of n≧1) and n←0 (in the case of n≦0)] (S14'). In this case, when one of the three lines is the blank line, the number n is incremented by one. Therefore, only one of the three lines, i.e., one of the second to fourth lines after the La number of lines (La+the second to fourth lines) is the blank line, and the first, fifth and sixth lines after the La number of lines (La+the first, fifth and sixth lines) are the print lines, the number n become four (n=4) (S18: No) when the sixth line after the La number of lines (La+the sixth line) is printed.

In addition, in case where the number of blank lines before the printing is not determined to be above the set number M of the blank lines (M≦m) (S16: No), another clearing processing (S24) of the number m of consecutive blank lines prevents adjustment processing (S17 to S19) to be performed. This is because, the adjustment processing is performed when the blank lines are included in the consecutive print lines at intervals, and the total number m becomes M or greater number due to the increment processing (S15) of the number m. In case where the blank lines are included, heat is radiated due to these blank lines. Therefore, considering this heat dissipation, the number m may be set to [m←m−1 (in the case of m≧1) and m←0 (in the case of m≦0)] (S25) as shown in a broken line so that the number m is cleared after being decremented to zero. In this case, when the increment processing (S15) of the number m is performed multiple times more than the decrement processing (S25) thereof (i.e. the number of blank lines is larger) and the difference thereof becomes M or larger (Sl6: Yes), and adjustment processing (S17 to S19) is performed.

Figure 8:
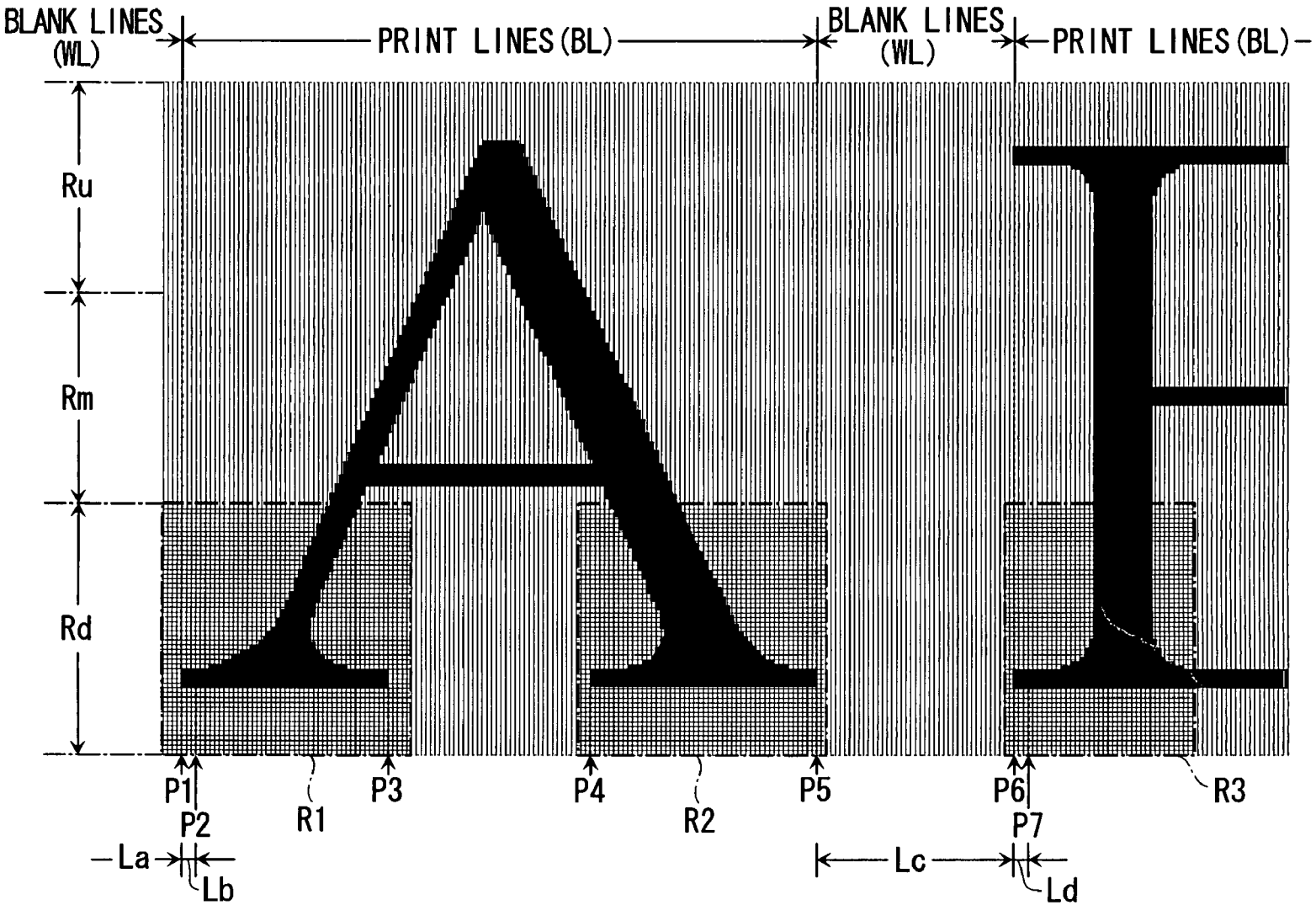
FIG. 8 is an explanatory enlarged view showing the vicinity of the first character "A" of FIG. 7.
Figures 9A, 9B, 9C:
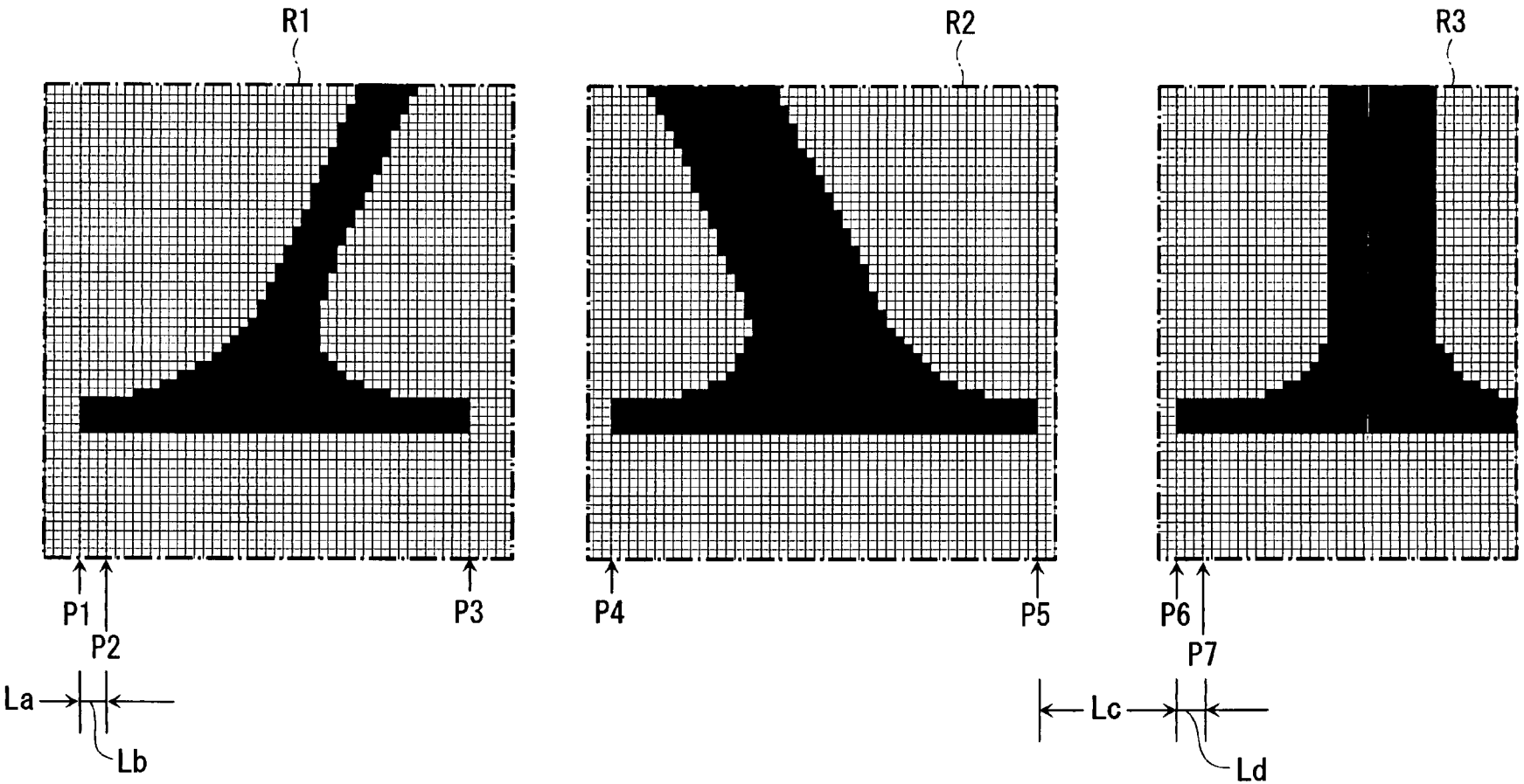
FIGS. 9A to 9C are further explanatory enlarged views showing a part of the regions of characters in FIG. 8.
Figure 10:
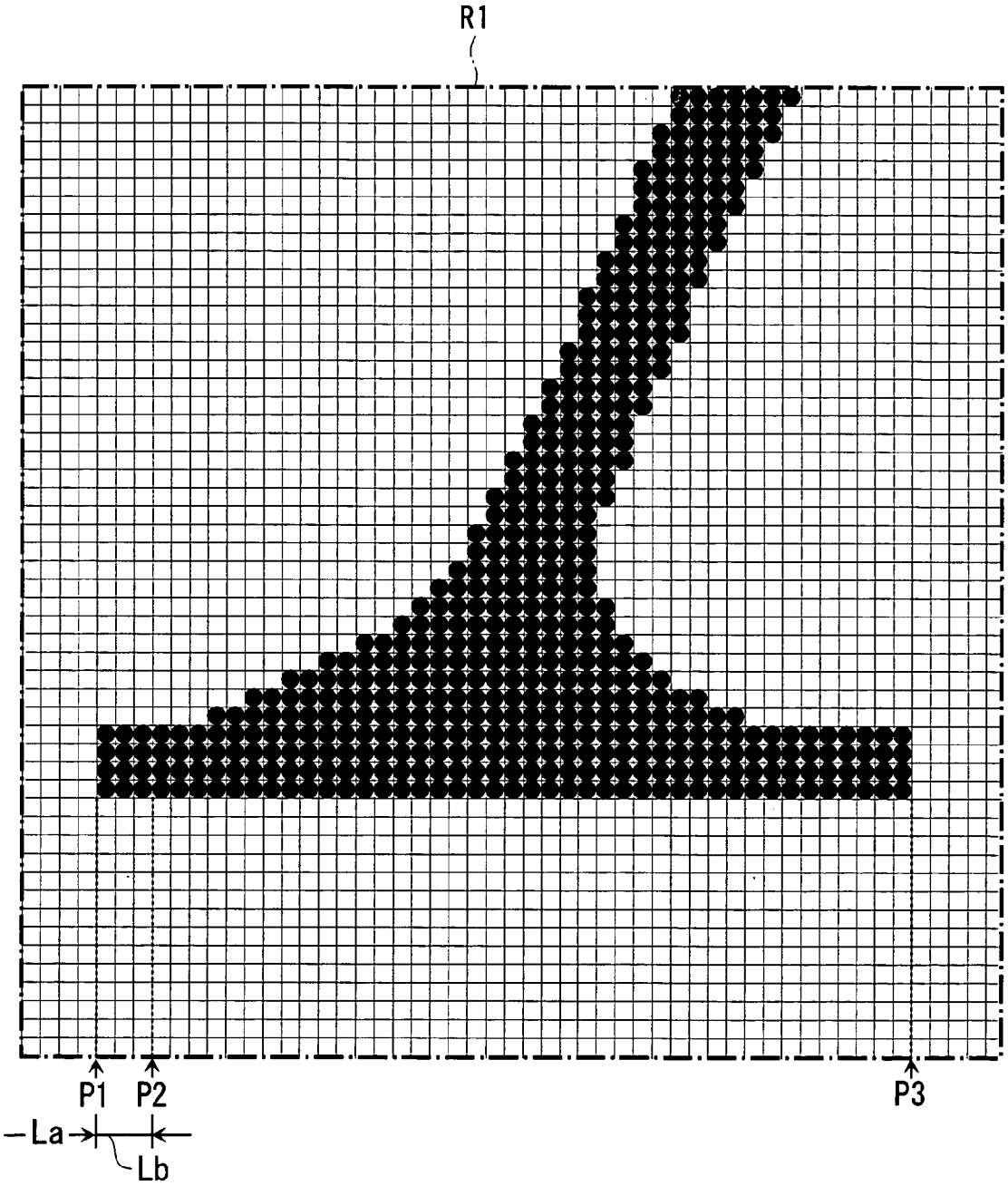
FIG. 10 is further an explanatory enlarged view showing a region RI in FIG. 9A.

In the case of the above-described embodiment, the dots arrayed in the tape width direction are treated as one dot line (one line). Therefore, the dot lines between the illustrated positions P3 and P4 are treated as the print lines (BL). However, when it is feasible to divide the heating elements (dots) of the print head 7 into a plurality of regions in a tape width direction and control (applied energy of) the divided heating elements, i.e., when the dots can be divided into, for example, an upper region Ru, a middle region Rm and a bottom region Rd as shown in FIG. 8 and controlled, the lines between the illustrated positions P3 and P4 can be treated as the blank lines (WL).

Moreover, in the foregoing embodiment, the strobe width of the strobe signal Vd in a steady state is set to be a standard (i.e. the standard strode width), and the standard strobe width is multiplied by a coefficient (1 or greater in this case) to increase the width, thus obtaining the strobe signals Va to Vc as shown in FIG. 12. However, a strobe signal with a wide strobe width (for example, the strobe signal Va) may be used as a standard and multiplied by a coefficient of 1 or smaller value to obtain a strobe signal with a narrow strobe width (for example, the strobe signal Vd). In the case of obtaining the strobe signal with a narrow width, processing for adjusting the strobe width (applied energy) may be added after the processing (S24) in FIGS. 6A and 6B. Further, since heat generated in the print head is so-called Joule heat, adjustment of the applied energy to be provided can be carried out by adjusting not only the strobe width (application duration), but an applied voltage or an applied current. The adjustment of the applied energy can be carried out by any one of or a combination of the above adjustments.

The initial value of the number m of consecutive WL is set to be zero (m=0). However, the number m may be initialized to a counted value saved at the end of previous printing or a value obtained by converting stand-by duration from the previous printing to the beginning of present printing into the number m. Alternatively, for example, by setting the initial value of the number m to be a predetermined value or greater value, printing of the print image can be started as if there were above the set number M of blank lines. In this case, heat dissipation before starting the printing is treated as if there were the consecutive blank lines. Thus, when printing the first print line after the printing is started, the applied energy is increased to exceed a standard value, and thereby a sufficient heat quantity can be provided to the print head 7 where the amount of accumulated heat is insufficient when the printing is started. The number of the first blank lines La is set to be La≧10 in the example of the print line G0. However, if the initial value of the number m is set to be, for example, seven (m=7) (S11), the number m becomes m≧7+3=10 with the number of the blank lines La of La≧3. Accordingly, the number of the blank lines before printing becomes above the set number M of blank lines (M≦m) (S16: Yes), and thus the applied energy is increased (Sl9). In addition, if the initial value is set to be zero (m=0), the applied energy is similarly increased (S19) even with the first blank line La of zero (La=0).

The above-described print processing (S10) may be applied as a program to be processed by a tape printing apparatus in which a program can be processed. In addition, the print processing (S10) may also be applied to a storage medium such as a compact disc (CD) for storing the above kind of program. By storing this kind of program or reading it out from the storage medium or the like and then executing the program, the energy applied to the print head is adjusted corresponding to the content of the print image. Thus, image quality degradation can be prevented. As a matter of course, changes can be made as appropriate without departing from the gist of this invention.

In the above-described embodiment, the strobe width is adjusted under conditions that the number of blank lines which are consecutively present before printing is above the set number M of blank lines (M≦m), and that the number of print lines which are consecutively present before printing is not the set number N of print lines or greater number of the same (N≦n). However, values of the numbers M and N can be changed as required. Additionally, a former part of the conditions that the number of blank lines (WL) which are consecutively present before printing is above the set number M of blank lines can be changed to a condition that the duration of no printing (duration when the blank lines are consecutively present) before printing is a set duration K or longer duration. In this case, however, the duration with the consecutive blank lines (duration of consecutive blank lines) is varied depending on a high or low printing speed. Thus, print control is performed considering a printing speed. This case is described below as a second embodiment.

Figure 14A:
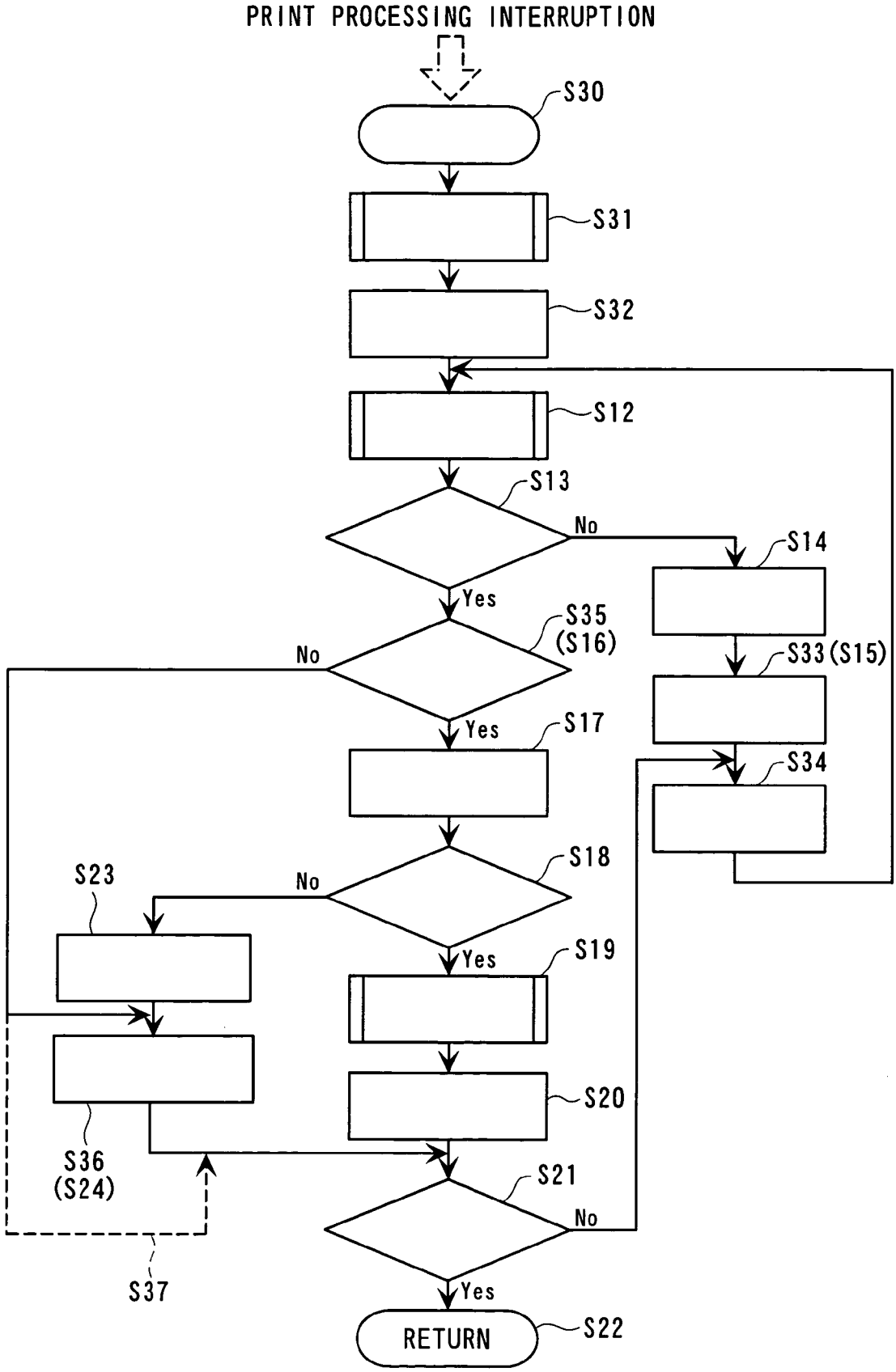

In a tape printing apparatus 1 of this (second) embodiment, once a user presses a print key, a print processing interruption is generated. Then, as shown in FIGS. 14A and 14B, the print processing (S30) is started with a displayed massage "printing" (D11 in FIG. 5). First of all, the duration k of consecutive blank lines (WL) is initialized to zero (k=0), and the number n of consecutive print lines (BL) is initialized to zero (n=0). A value of the timer 251 (timer value TIM: hereinafter, simply referred to as "timer TIM") is initialized to zero (TIM2=0), and a timer value TIM2, which is a saved (or temporarily retained) timer value, is initialized to zero (TIM2=0) (S31).

In the following, the set duration K of blank lines is set to be K=10×(tape feed duration for one line: equivalent to a printing speed). In a manner similar to the first embodiment, the set number N of print lines is set to be three (N=3), and the number of the first blank lines La is set to be La≧10. The same processing as the print processing (S10) shown in FIGS. 6A and 6B in the first embodiment is designated by the same reference numeral, and the numerals in brackets in FIGS. 14A and 14B designate the equivalent processing in the print processing (S10). In a manner similar to the first embodiment, the print image G0 shown in FIGS. 7 to 11 is used as an example in this description.

Once each of the initializations is finished (S31), clocking (i.e. counting of the timer TIM) starts immediately (S32). Thereafter, the print image data is retrieved and the first line is analyzed so as to be prepared for printing (S12). Next, it is determined whether or not the prepared line is the "print line" (S13). In the print image G0, the first line is the "blank line" (S13: No), and the number n of consecutive BL is cleared to be zero (n←0) (S14).

In this processing (S30), obtained is an accumulation of duration when the consecutive blank lines (WL) are present. Therefore, the duration k of consecutive WL is renewed based on [k←k+TIM−TIM2] (S33). Here, the duration k is zero (k=0), the timer value TIM is zero (TIM=0) and the timer value TIM2 is zero (TIM2=0) in the initial state. Therefore, an elapsed time from timer TIM start processing (S32) is TIM, and duration k is k=TIM (=elapsed time from the timer TIM start processing (S32)) (S33) based on k←k+TIM−TIM2. Next, a present value of timer TIM (at the present point) is retained (saved) as the timer value TIM2 based on [TIM←TIM2] (S34).

Next, the print image data is retrieved, and the next line is analyzed and prepared (S12) and then determined whether or not it is the print line (S13). Similarly, the next line is the "blank line" in the printing image G0 (S13: No). Therefore, the number n of consecutive BL is cleared (S14) and then the duration k of consecutive WL is renewed based on [k←k+TIM−TIM2] (S33). Here, the duration k of consecutive WL is renewed by cumulating the value obtained by subtracting the previously renewed timer value TIM2 from the present timer value TIM, i.e. the value equivalent to elapsed time from the previous renewal TIM−TIM2 (S33). Next, the timer value TIM at the present point is retained (i.e. renewed) as the timer value TIM2 (S34).

Similarly, the lines up to the La-th line are analyzed (see FIGS. 7 to 10) and determined to be the blank lines (S13: No). Thereafter, the duration k of consecutive blank lines (WL) becomes about La×(tape feed duration for one line). Since the number La of first blank lines of the print image G0 is set to be La≧10, the duration k becomes k≧K (=10×(tape feed duration for one line: equivalent to a printing speed)). At this point, analysis of the La number of lines from the first to the La−th line (up to the position P1) is finished.

Next, the print image data is retrieved, and the next line is analyzed and prepared (S12) and then determined whether or not it is the print line (S13). The next line (the line right after the position P: La+the first line) is the print line (S13: Yes). It is determined whether or not the print line which is to be printed from now is printed after the set duration K of blank lines or longer duration of the same (i.e. whether or not K≦k) (S35). Here, since the duration k is k≧=K, the print line is printed after the set duration K of blank lines or longer duration of the same (K≦k) (S35: Yes).

Once the duration of consecutive blank lines before printing is determined to be the set duration K of blank lines or longer of the same (K≦k) (S35: Yes), the first line after the La number of lines (La+the first line) is printed by applying the strobe signal Va with an adjusted strobe width (applied energy) (S17 to S18 to S19 to S20) in a manner similar to the first embodiment in FIG. 6. Once the printing is finished, it is determined whether or not printing is completed (S21). Here, since the printing is not completed yet (S21: No), the timer value TIM at the present point is retained as the timer value TIM2 (S34). In this case, the present timer value TIM2 is retained (renewed) without renewing the duration k of consecutive WL (S33), i.e. without cumulating the value equivalent to the elapsed time from the previous renewal TIM−TIM2. Due to this, cumulating of the duration k is temporarily stopped (omitted) (S34).

Next, the next print image data is retrieved and the next line is analyzed and prepared (S12). The next line (La+the second line) is also the print line (S13: Yes). Therefore, the duration of consecutive blank lines before printing is determined to be the set duration K of blank lines or longer of the same (K<k) (S35: Yes). Thereafter, the second line after the La number of lines (La+the second line) is printed by applying the strobe signal Vb with the adjusted strobe width (applied energy) (S17 to S18 to S19 to S20). It is then determined that the printing is not completed (S21: No) and the timer value TIM2 at the present point is retained (renewed) (S34).

Similarly, the next line (La+the third line) is determined to be a print line, and the duration k of consecutive blank lines before printing is determined to be the set duration K of blank lines or longer duration of the same. Thereafter, the third line after the La number of lines (La+the third line) is printed by applying the strobe signal Vc with the adjusted strobe width (S12 to S13 to S35 to S17 to S18 to S19 to S20). It is then determined that the printing is not completed (S21: No) and the timer value TIM2 at the present point is retained (renewed) (S34). At this point, the number n of consecutive BL is three (n=3).

Next line (La+the fourth line) is determined to be a print line (S13: Yes), and the duration of consecutive blank lines before printing is determined to be the set duration K of blank lines or longer duration of the same (K≦k) (S35: Yes). The number n of consecutive BL is counted and the number n is four (n=4) (S17). The number n here is n(=4)>N(=3). Thus, the number of the print lines before printing is no longer the set number N of print lines or greater number of the same (S18: No). Next, the number n of consecutive BL is cleared (n←0) (S23), and then the duration k of consecutive WL is cleared (k←0) (S36). Thereafter, the printing of the fourth line after the La number of lines (La+the fourth line) is finished (S20) by applying the strobe signal Vd without the adjusted strobe width. Since the printing is not completed (S21: No), the timer value TIM2 at the present point is renewed (S34).

Next line (La+the fifth line) is also analyzed (Sl2) and determined to be a print line (S13: Yes). However, the duration k of consecutive WL is cleared (k=0), and thus determined not to be the set duration K of blank lines or longer duration of the same (K≦k) (S35: No). Next, after the duration k of consecutive WL is cleared (k←0) (S36: the reason of this clearing is described later), and the printing of the fifth line after the La number of lines (La+the fifth line) is finished (S20) by applying the strobe signal Vd with the standard strobe width. Since the printing is not completed (S21: No), the timer value TIM2 at the present point is renewed (S34).

Next, the next line (La+the sixth line) and the following lines are processed in a manner similar to the fifth line after the La number of lines (La+the fifth line) (loop processing of S12 to S13 to S35 to S36 to S20 to S21 to S34 to S12 is performed). Specifically, the La number of lines to the position P1 is not printed because they are the blank lines (WL) whereas three (=N) lines Lb (=N) between the positions P1 and P2 are printed by the strobe signals Va, Vb and Vc with adjusted strobe widths (applied energy). The lines between the positions P1 and P5 are printed by applying the strobe signals Vd with the standard strobe widths without adjustment. At this point, printing of the character "A" out of the character image "A B C D E" of the print image G0 is finished.

At the point when the printing of the lines to the position P5 of the print image G0 is finished, the printing is not completed (S21: No). Therefore, the next line is similarly analyzed (S12). The lines between the positions P5 and P6 are not printed as they are the blank lines (WL). Thus, the number K becomes K≦k (=about Lc×(tape feed duration for one line)) by the processing for the line between the positions P5 and P6 (a loop processing of S12 to S13 to S14 to S33 to S34 to S12), and the duration k of consecutive blank lines before printing is the set duration K of blank lines or longer duration of the same (K≦k) (S35: Yes). Thus, the three (=N) lines Ld (=N) between the positions P6 and P7 are printed by applying the strobe signals Va, Vb and Vc with adjusted applied energy. The following lines are printed by the strobe signals Vd with the standard strobe widths and the similar processing is continued. Consequently, printing of the entire character image "A B C D E" of the print image G0 is completed (S21: Yes). Thereafter, the print processing (S30) is finished (S22) and screen returns to the original text editing screen (D12 in FIG. 5).

As described above, in the tape printing apparatus 1 of this embodiment, the line analysis result is obtained by analyzing whether or not the line is the print line (BL) or the blank line (WL). While printing (to be more specific, while the tape is relatively moving for printing the print image: while sending the tape), detected is the duration k of consecutive blank lines when printing is not consecutively performed due to the blank lines. Then, the energy applied to the print head 7 for printing each print line is adjusted based on the duration k of consecutive blank lines and the number n of consecutive BL. Methods for adjusting the applied energy and for obtaining the adjusted applied energy by the use of a coefficient or the like as well as variations of these methods are similar to those of the first embodiment. Therefore, description thereof is omitted.

To be more specific, when printing the print line after the duration k of consecutive blank line becomes the set duration K of blank lines or longer duration of the same, the applied energy is increased to exceed the standard value. Therefore, a sufficient heat quantity can be provided to the print head 7 in which the amount of accumulated heat is insufficient due to heat dissipation after the duration k of consecutive blank lines. Accordingly, image degradation due to lack of heat quantity can be prevented. Moreover, in a manner similar to the first embodiment, as for the following print lines after the set number N of consecutive print lines or greater number of the same, the setting (adjustment) thereof is returned to the initial one so that image degradation due to excessive heating is prevented. Still further, by appropriately setting the initial value of the duration k of consecutive blank lines, printing of the print image can be started as if the set duration of blank lines or loner duration were elapsed or will soon be elapsed. In these cases, heat dissipation before starting the printing is treated as head radiation due to the duration k of consecutive blank lines. Thus, when printing the first print line after the printing is started, the applied energy is increased to exceed a standard value, and thereby a sufficient heat quantity can be provided to the print head 7 in which the amount of accumulated heat is insufficient when the printing is started.

When it is determined that the duration k of consecutive blank lines before printing is not the set duration K or longer duration (K≦k) (S35: No), another clearing processing (S36) of the duration k prevents adjustment processing (S17 to S19) to be performed. This is because, the adjustment processing is performed when the blank lines are included in the consecutive print lines at intervals, and the total duration k becomes K or longer duration due to the renewal of the duration k (S33). In case where the blank lines are included in the print lines, heat is radiated due to these blank lines. Therefore, the clearing processing (S36) may be omitted, considering such heat dissipation (following a flow tentatively denoted by S37 shown in a broken line). In this case, the print lines are not cumulated for the duration k due to the renewal of the timer value TIM2 (S34) whereas the blank lines are cumulated even though they are present at intervals (S33). Therefore, when the cumulated duration becomes the duration K or longer duration (S35: Yes), the adjustment processing (S17 to S19) is performed. Moreover, when the blank lines are included at intervals, the processing which is equivalent to S25 in FIG. 6 of the first embodiment may be performed, i.e. decrement (return timing) processing by a predetermined duration may be performed.

Furthermore, in the above mentioned embodiment, it is possible to divide the dots in the tape width direction and control them in a manner similar to the first embodiment. For example, as shown in FIG. 8, when it is possible to control the dots divided into the upper region Ru, the middle region Rm and the bottom region Rd, the lines between the illustrated positions P3 to P4 can be treated as the blank lines (WL).

Moreover, the initial value of the duration k is set to be zero (k=0). However, the number k may be initialized to be a value of timing result when the previous printing is finished or the value of stand-by duration from the previous printing to the beginning of the present printing. Moreover, instead of this, similar time may be set as an initial value of timer TIM. Further, in the forgoing example, when the number La of blank lines is La≧10, the initial values of the TIM and TIM2 are set to be zero (TIM=0, TIM2=0) (S31) so that duration k of blank lines becomes the set duration K or longer duration. However, if these initial lines are adjusted, the duration of blank lines before printing becomes the set duration K or longer duration (K≦k) (S35: Yes) even with a smaller value (for example, the number La of the blank lines is La≧3).

The print processing (S30) mentioned above may be applied as a program to be processed by a tape printing apparatus in which a program can be processed. The print processing (S30) may also be applied to a storage medium such as a CD for storing this kind of program. By storing this kind of program or reading it out from the storage medium or the like and then executing the program, the energy applied to the print head is adjusted corresponding to the content of the print image and a printing speed. Thus, image quality degradation can be prevented. As a matter of course, changes can be made as appropriate without departing from the gist of this invention.

As described so far, with the tape and the print control method thereof according to the present invention, there are advantages that image deterioration of the print image can be prevented by adjusting the energy applied to the print head corresponding to the content of the print image.

What is claimed is:

1. A tape printing apparatus for printing a print image by each dot line onto a tape by driving a plurality of heating elements of a print head, the heating elements being aligned corresponding to the dot lines of the print image where dots are arrayed in a width direction of the tape, while moving the tape in a longitudinal direction thereof relative to the print head, the tape printing apparatus comprising:

dot line analyzing means for analyzing each of the dot lines of the print image made up of a mixture of print lines which are the dot lines including the dots to be printed and blank lines which are the dot lines including no dots to be printed, whereby each of the dot lines is analyzed to be the print line or the blank line, thereby obtaining a line analysis result;

means for detecting, based on the line analysis result, a duration of the consecutive blank lines when printing is not consecutively performed while the tape is moved, due to the consecutive blank lines on the tape in a longitudinal direction thereof;

applied energy adjusting means for adjusting the energy applied to the print head in printing each of the print lines, based on the duration of the consecutive blank lines and the number of the consecutive print lines from the line analysis result.

2. The tape printing apparatus according to claim 1, wherein the applied energy adjusting means has applied energy increasing means for increasing the value of the applied energy when printing the print line after the duration of the consecutive blank lines reaches a value above a set duration of the consecutive blank lines.

3. The tape printing apparatus according to claim 2, wherein the means for detecting the duration of consecutive blank lines has means for initializing an initial value of the duration of the consecutive blank lines to a value above a predetermined value, when the printing of the print image is started.

4. The tape printing apparatus according to claim 2, wherein the applied energy adjusting means has applied energy reset means which resets the value of the increased applied energy to an original value in case where more than the set duration time of the blank lines is elapsed and in case the print line is printed after more than the set number of the consecutive print lines lasted.

5. The tape printing apparatus according to claim 1, wherein adjustment of the applied energy is carried out by adjusting a strobe width of a strobe pulse which is applied to the print head.

6. The tape printing apparatus according to claim 1, wherein the adjustment of the applied energy is carried out by adjusting a voltage that is applied to the print head.

7. The tape printing apparatus according to claim 1, wherein the adjustment of the applied energy is carried out by adjusting a limit value of a current applied to the print head.

8. The tape printing apparatus according claim 1, wherein the adjustment of the applied energy is carried out by multiplying a value serving as a reference by a predetermined coefficient.

9. A program for performing a function of each of the means of the tape printing apparatus according to claim 1, said program being arranged to be capable of being implemented by a programmable tape printing apparatus.

10. A program for performing the method of controlling printing by the tape printing apparatus according to claim 1, said program being arranged to be capable of being implemented by a programmable tape printing apparatus.

11. A storage medium having stored therein a program for performing a function of each of the means of the tape printing apparatus according to claim 1, said program being arranged to be capable of being implemented by a programmable tape printing apparatus.

12. A method of controlling printing by a tape printing apparatus for printing a print image by each dot line onto a tape by driving a plurality of heating elements of a print head while moving the tape in a longitudinal direction thereof relative to the print head, the heating elements being aligned corresponding to the dot lines of the print image where dots are arrayed in a width direction of the tape, the method comprising the steps of:

analyzing each of the dot lines of the print image made up of a mixture of print lines which are the dot lines including the dots to be printed and blank lines which are the dot lines including no dots to be printed, whereby each of the dot lines is analyzed to be the print line or the blank line, thereby obtaining a line analysis result;

detecting a duration of consecutive blank lines based on the line analysis result when printing is not continuously performed, while the tape is moved, due to the consecutive blank lines on the tape in a longitudinal direction thereof; and adjusting energy to be applied to the print head in printing a print line, based on the duration of the consecutive blank lines and the number of the consecutive print lines according to the line analysis result.

13. A storage medium having stored therein a program for performing a function of each of the means of the tape printing apparatus according to claim 12, said program being arranged to be capable of being implemented by a programmable tape printing apparatus.

* * * * *